US006129995A

United States Patent [19]

Hashimoto et al.

[11] Patent Number: 6,129,995

[45] Date of Patent: Oct. 10, 2000

[54] ZINCIFEROUS COATED STEEL SHEET AND METHOD FOR PRODUCING THE SAME

[75] Inventors: Satoshi Hashimoto; Toru Imokawa; Michitaka Sakurai; Takayuki Urakawa, all of Fukuyama; Junichi Inagaki, Yokohama; Masaru Sagiyama, Fukuyama, all of Japan

[73] Assignee: NKK Corporation, Tokyo, Japan

[21] Appl. No.: 09/039,981

[22] Filed: Mar. 16, 1998

[30] Foreign Application Priority Data

Mar. 19, 1997 [JP] Japan ..... 9-066620
Sep. 26, 1997 [JP] Japan ..... 9-261705

[51] Int. Cl.[7] ..... C23C 2/06; C25D 5/26

[52] U.S. Cl. ..... 428/629; 428/633; 428/639; 428/659

[58] Field of Search ..... 428/629, 633, 428/639, 659

[56] References Cited

U.S. PATENT DOCUMENTS 4,578,122 3/1986 Crotty .
5,849,423 12/1998 Urakawa et al. .

FOREIGN PATENT DOCUMENTS 0738790 10/1996 European Pat. Off. .
53-060332 5/1978 Japan .
58-067885 4/1983 Japan .
2-190483 7/1990 Japan .
3-191093 8/1991 Japan .
4-088196 3/1992 Japan .

OTHER PUBLICATIONS

Database WPI, Section Ch, Week 7805, Derwent Publications Ltd., Class M13, An 78–09533A XP002060634 of JP 52 152834 A (Nisshin Steel Co Ltd), Dec. 19, 1977.

Patent Abstracts of Japan, vol. 012, No. 467 (C–550), Dec. 7, 1988 of JP 63 186883 A (Nippon Steel Corp), Aug. 2, 1988.

Patent Abstracts of Japan, vol. 012, No. 358 (C–531), Sep. 26, 1988 of JP 63 114999 A (Sumitomo Metal Ind Ltd), May 19, 1988.

*Primary Examiner*—Deborah Jones
*Assistant Examiner*—Jason Savage
*Attorney, Agent, or Firm*—Frishauf, Holtz, Goodman, Langer & Chick, P.C.

[57] ABSTRACT

A zinciferous coated steel sheet comprises a steel sheet, a zinciferous coating layer formed on the steel sheet, a Fe—Ni—Zn—O film formed on the zinciferous coating layer, and an oxide layer formed on a surface portion of the Fe—Ni—Zn—O film. The method comprises providing an electrolyte of an acidic sulfate aqueous solution, carrying out an electrolysis treatment in the electrolyte under a current density ranging from 1 to 150 A/dm$^2$, and carrying out an oxidation treatment to a surface of the zinciferous coated steel sheet.

8 Claims, 3 Drawing Sheets

ZINCIFEROUS COATED STEEL SHEET AND METHOD FOR PRODUCING THE SAME

BACKGROUND OF THE INVENTION

1. Field of the Invention

The present invention relates to a zinciferous coated steel sheet and a method for producing the same.

2. Description of the Related Arts

Owing to various advantages, zinciferous coated steel sheets are widely used as rust-proof steel sheets. For utilizing the zinciferous coated steel sheets as the rust-proof steel sheets for automobiles, however, excellent press-formability and adhesiveness are requested as the characteristics requirements in the car body manufacturing line, as well as corrosion resistance and the like.

Zinciferous coated steel sheets, however, generally have a disadvantage of inferiority in press-formability to cold-rolled steel sheets. The drawback results from a large sliding resistance between the zinciferous coated steel sheet and the press mold compared with that observed in cold-rolled steel sheets. That is, the large sliding resistance interferes with the entering of the zinciferous coated steel sheet into the press mold at a portion where vigorous sliding occurs between the bead and the zinciferous coated steel sheet, which tends to induce fracture of the steel sheet.

There is a common practice of applying high viscosity lubricant to improve the press-formability of zinciferous coated steel sheet. This method has, however, problems that the viscous lubricant induces coating defects during the coating process caused by insufficient degreasing, and that lack of oil during the pressing stage results in unstable press performance. Therefore, improvement of press-formability of zinciferous coated steel sheets is strongly desired.

In addition, in the manufacturing line of automobile bodies, various kinds of adhesives are used for anti-rusting and damping of car bodies. In recent years, it was found that the adhesiveness of zinciferous coated steel sheets is inferior to that of cold-rolled steel sheets. Accordingly, improvement of adhesiveness of zinciferous coated steel sheets is also desired.

As a measure to solve the above-described problems, Japanese Patent Laid-Open No. 53-60332 and No. 2-190483 disclose technology to form an oxide film consisting mainly of ZnO on the surface of zinciferous coated steel sheet through electrolysis treatment, immersion treatment, applying-oxidizing treatment, or heating treatment: (hereinafter the technology is referred to as "Prior Art 1").

Japanese Patent Laid-Open No. 4-88196 discloses technology to improve press-formability and chemical treatability by forming an oxide film consisting mainly of P-oxide on the surface of zinciferous coated steel sheet by immersing the coating steel sheet in an aqueous solution containing 5 to 60 g/liter of sodium phosphate, or by electrolysis treatment, or by spraying the above-described aqueous solution: (hereinafter the technology is referred to as "Prior Art 2").

Japanese Patent Laid-Open No. 3-191093 discloses technology to improve press-formability and chemical treatability by forming a Ni-oxide on the surface of zinciferous coated steel sheet through electrolysis treatment, immersion treatment, applying treatment, applying-oxidizing treatment, or heating treatment: (hereinafter the technology referred to as "Prior Art 3").

Japanese Patent Laid-Open No. 58-67885 discloses technology to improve corrosion resistance by forming a film of metal such as Ni and Fe on the surface of zinciferous coated steel sheet through the film-forming method is not particularly specified: (hereinafter the technology is referred to as "Prior Art 4").

The above-described Prior Arts have drawbacks described below.

Since Prior Art 1 is a method to form an oxide consisting mainly of ZnO on the surface of the coating layer, the workability is improved, but there appears less of improvement of press-formability because the sliding resistance between the press mold and the coated steel sheet does not sufficiently reduce. In addition, it has been identified that, if an oxide consisting mainly of ZnO exists on the surface of the steel sheet, the adhesiveness is further degraded.

Since Prior Art 2 is a method to form an oxide film consisting mainly of P-oxide on the surface of zinciferous coated steel sheet, it has a problem of degrading the adhesiveness, though the effect of improvement of press-formability and chemical treatability is high.

Since Prior Art 3 is a method to form a film of Ni-oxide single phase, it has not sufficient effect to improve adhesiveness, though the press-formability is improved.

Since Prior Art 4 is a method to form a film of metal such as Ni, it cannot give satisfactory adhesiveness owing to poor wettability against adhesives because of strong metallic characteristics of the film, though the corrosion resistance is improved.

SUMMARY OF THE INVENTION

It is an object of the present invention to provide a zinciferous coated steel sheet excellent in press-formability and adhesiveness, and to provide a method for producing the same.

To attain the object, the present invention provides a zinciferous coated steel sheet comprising a steel sheet, a zinciferous coating layer which is formed on the steel sheet, a Fe—Ni—Zn—O film which is formed on the zinciferous coating layer, and an oxide layer which is formed on a surface portion of the Fe—Ni—Zn—O film.

The Fe—Ni—Zn—O film comprises metallic Ni and an oxide of Fe, Ni and Zn. The Fe—Ni—Zn—O film has a Fe ratio of 0.004 to 0.9 and a Zn ratio of 0.6 or less. The Fe ratio is a ratio of Fe content (wt. %) to the sum of Fe content (wt. %), Ni content (wt. %), and Zn content (wt. %) in the Fe—Ni—Zn—O film. The Zn ratio is a ratio of Zn content (wt. %) to the sum of Fe content (wt. %), Ni content (wt. %), and Zn content (wt. %) in the Fe—Ni—Zn—O film. The oxide layer comprises an oxide of Fe, Ni and Zn. The oxide layer has a thickness of 0.5 to 50 nanometer.

The Fe—Ni—Zn—O film may comprise metallic Ni, an oxide of Fe, Ni and Zn, and a hydroxide of Fe, Ni and Zn. It is preferable that the Fe—Ni—Zn—O film has a coating weight of 10 to 2500 mg/m$^2$. The oxide layer may comprise an oxide of Fe, Ni and Zn, and a hydroxide of Fe, Ni and Zn.

Further, the present invention provides a zinciferous coated steel sheet comprising a steel sheet, a zinciferous coating layer which is formed on the steel sheet, a Fe—Ni—Zn film which is formed on the zinciferous coating layer and contains Fe, Ni and Zn, and the Fe—Ni—Zn film having an oxide layer at a surface portion thereof and a metal layer at a lower portion thereof.

The oxide layer comprises an oxide of Fe, Ni and Zn, and a hydroxide of Fe, Ni and Zn. The oxide layer has a thickness of 4 to 50 nanometer. The metal layer comprises Fe, Ni and Zn.

The Fe—Ni—Zn film has a sum of the Fe content (mg/m$^2$) and the Ni content (mg/m$^2$), said sum being from 10 to 1500 mg/m$^2$. The Fe—Ni—Zn film has a Fe ratio of 0.1 to 0.8 and a Zn ratio of at most 1.6. The Fe ratio is a ratio of Fe content (mg/m$^2$) to the sum of Fe 2 5 content (mg/m$^2$) and Ni content (mg/m$^2$) in the Fe—Ni—Zn film. The Zn ratio is a ratio of Zn content (mg/m$^2$) to the sum of Fe content (mg/m$^2$) and Ni content (mg/m$^2$) in the Fe—Ni—Zn film.

Furthermore, the present invention provides a method for producing a zinciferous coated steel sheet comprising the steps of: (a) providing an electrolyte of an acidic sulfate aqueous solution; (b) carrying out an electrolysis treatment in the electrolyte using a zinciferous coated steel sheet as a cathode under a current density ranging from 1 to 150 A/dm$^2$; and (c) carrying out an oxidation treatment to a surface of the zinciferous coated steel sheet to which the electrolysis treatment was carried out.

The acidic sulfate aqueous solution contains $Fe^{2+}$ ion, $Ni^{2+}$ ion and $Zn^{2+}$ ion. A total concentration of $Fe^{2+}$ ion and $Ni^{2+}$ ion is 0.3 to 2.0 mol/liter. A concentration of $Fe^{2+}$ ion is 0.02 to 1 mol/liter and a concentration of $Zn^{2+}$ ion is at most 0.5 mol/liter. The electrolyte has a pH of 1 to 3 and a temperature of 30 to 70° C.

It is preferable to carry out the oxidation treatment to the surface of the zinciferous coated steel sheet by using any one of the following methods:

(A) A post-treatment is applied to the zinciferous coated steel sheet in a post-treatment liquid having a pH of 3 to 5.5 for a treatment period of t (seconds) defined by the following formula:

$$50/T \leqq t \leqq 10$$

where, T denotes a temperature (° C.) of the post-treatment liquid.

(B) The zinciferous coated steel sheet is washed with water having a temperature of from 60 to 100° C.

(C) Steam is sprayed to the zinciferous coated steel sheet.

DESCRIPTION OF THE EMBODIMENT

Embodiment 1

Figure 1:
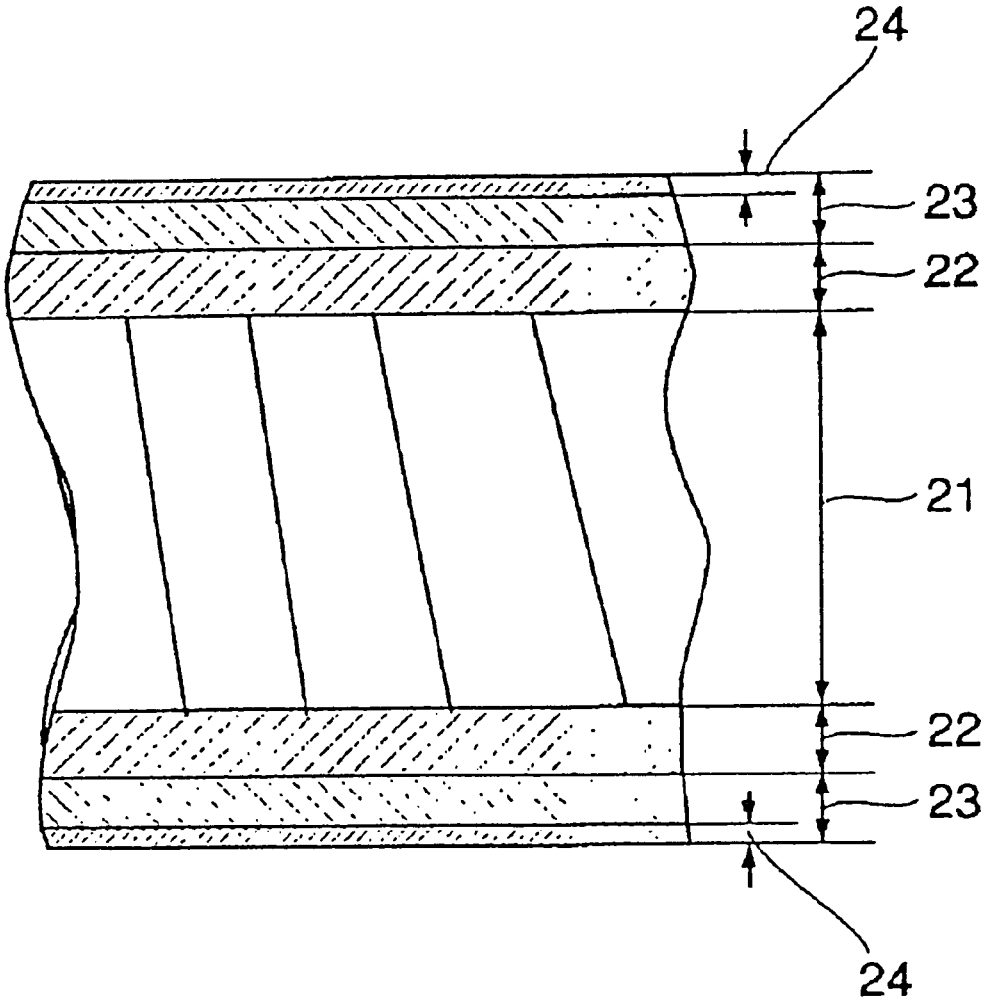
FIG. 1 is a cross sectional view of zinciferous coated steel sheet according to the present invention.

The inventors of the present invention found conditions to obtain a zinciferous coated steel sheet having excellent press-formability and adhesiveness. The conditions are as follows:

(a) A mixture film containing metallic Ni and an oxide of Fe, Ni, and Zn, is formed on a surface of a coating layer. The mixture film may contain metallic Ni, an oxide of Fe, Ni and Zn, and a hydroxide of Fe, Ni, and Zn. Hereinafter the mixture film is referred to as "Fe—Ni—Zn—O film".

(b) A surface layer part in the Fe—Ni—Zn—O film comprises a layer of an oxide of Fe, Ni, and Zn. The layer may comprise an oxide of Fe, Ni, and Zn, and a hydroxide of Fe, Ni, and Zn. Hereinafter the surface layer part is referred to simply as "oxide layer".

(c) The thickness of the oxide layer is controlled to an adequate value.

Since, as described above, zinciferous coated steel sheets have a large sliding resistance against the press mold compared with that of cold-rolled steel sheets, the press-formability of zinciferous coated steel sheets is inferior to that of cold-rolled steel sheets. The reason for a large sliding resistance is the occurrence of adhesion phenomenon under high face contact pressure between the mold and zinc which has a low melting point. The inventors considered that it is effective to form a film having a higher melting point than that of zinc or a zinc alloy coating layer to prevent the adhesion phenomenon.

Based on the above-described consideration, the inventors further conducted study, and found that the sliding resistance between the surface of coating layer and the press mold is reduced during the press-forming operation by forming an adequate Fe—Ni—Zn—O, film on the surface of zinciferous coated steel sheet and that, therefore, the zinciferous coated steel sheet becomes easy to slide into the press mold, thus improving the press-formability.

It is known that the adhesiveness of zinciferous coated steel sheets is inferior to that of cold-rolled steel sheets. The cause was, however, not known. To this point, the inventors found that the adhesiveness is controlled by the composition of oxide film on the surface of steel sheet. That is, the oxide film on the surface of cold-rolled steel sheet is occupied by Fe oxide, and the oxide film on the zinciferous coated steel sheet is occupied by Zn oxide. It was found that Zn oxide is inferior in adhesiveness to that of Fe oxide. In addition, it was also found that a Zn or Zn alloy coating gives a different adhesiveness depending on the composition of the surface oxide film, and that an increased quantity of Zn oxide gives poorer adhesiveness. Furthermore, it was found that the adhesiveness is further improved when an adequate Fe—Ni—Zn—O film is formed while no metallic element such as metallic Ni and metallic Zn is exposed on the surface thereof.

The present invention has been derived based on the findings described above, and the zinciferous coated steel sheet having excellent press-formnability and adhesiveness according to the present invention, comprises: an Fe—Ni—Zn—O film containing metallic Ni and an oxide or both of an oxide and a hydroxide of Fe, Ni, and Zn, being formed on the surface of coating layer at least one side of the zinciferous coated steel sheet; wherein a surface layer part in the Fe—Ni—Zn—O film is structured by an oxide layer consisting of an oxide or both of an oxide and a hydroxide of Fe, Ni, and Zn, while the thickness of the oxide layer is in a range of from 0.5 to 50 nanometer, the ratio of Fe content (wt. %) to the sum of Fe content (wt. %), Ni content (wt. %), and Zn content (wt. %) in the Fe—Ni—Zn—O film is in a range of from 0.004 to 0.9, and the ratio of Zn content (wt. %) to the sum of Fe content (wt. %), Ni content (wt. %), and Zn content (wt. %) is 0.6 or less.

The following are the reasons to limit the composition of Fe—Ni—Zn—O film formed on the surface of coating of zinciferous coated steel sheet according to the present invention, and the thickness of the oxide film formed on the surface layer in Fe—Ni—Zn—O film thereof.

FIG. 1 shows a cross sectional view of zinciferous coated steel sheet according to the present invention. The reference symbol 21 designates a steel sheet, 22 designates a zinc coating layer, 23 designates a Fe—Ni—Zn—O film containing metallic Ni and an oxide or both of an oxide and a hydroxide of Fe, Ni, and Zn, 24 designates an oxide layer consisting of an oxide or a hydroxide of Fe, Ni, and Zn.

According to the present invention, an Fe—Ni—Zn—O film containing metallic Ni and an oxide or both of an oxide and a hydroxide of Fe, Ni, and Zn is formed on the surface of zinc coating layer. The reason that the Fe—Ni—Zn—O film contains not only oxide of Fe, Ni, and Zn, and metallic Ni, but also hydroxide of Fe, Ni, and Zn is that, when a film containing oxide of Fe, Ni, and Zn, and metallic Ni is formed onto the surface of zinciferous coated steel sheet such as a zinc coated steel sheet, hydroxide of these elements may be unavoidably formed along with the above-described film.

Since the Fe—Ni—Zn—O film formed on the surface of the zinc or zinc alloy coated layer is a film having a higher melting point and a higher hardness than those of zinc, the sliding resistance becomes less by preventing the zinc adhesion phenomenon during press-forming operation. In addition, during sliding under a high face contact pressure, when the oxide in the surface layer is dropped off to expose a fresh surface, the lubricant is likely adsorbed onto the surface. Accordingly, the lubricant-adsorbed film further improves the effect of preventing the above-described adhesion phenomenon, thus preventing the increase in sliding resistance. Through the functions, the press-formability is improved.

Nickel in the above-described Fe—Ni—Zn—O film contributes to improve the weldability. The reason why the presence of Ni improves the weldability is not clear, but a presumable reason is that a Ni oxide having very high melting point suppresses the diffusion of zinc into the copper electrode, thus reducing the loss of copper electrode, or that Ni reacts with Zn to form a Ni—Zn alloy having a high melting point, thus suppressing the reaction between zinc and copper electrode.

In addition, inclusion of Fe oxide in the above-described Fe—Ni—Zn—O film provides an effect to improve the adhesiveness of the film.

The above-described Fe—Ni—Zn—O film may include Fe and Zn in a form of metallic Fe and metallic Zn, other than Fe and Zn contained in a form of oxide and hydroxide.

When the ratio of Fe content (wt. %) to the sum of Fe content (wt. %), Ni content (wt. %), and Zn content (wt. %) in the Fe—Ni—Zn—O film, (hereinafter referred to simply as "Fe/(Fe+Ni+Zn)"), is less than 0.004, the amount of Fe oxide which contributes to the adhesiveness is too small, thus resulting in no effect of improvement of adhesiveness. On the other hand, when Fe/(Fe+Ni+Zn) exceeds 0.9, the Ni content is reduced, thus degrading the press-formability and the spot weldability. Therefore, Fe/(Fe+Ni+Zn) in the Fe—Ni—Zn—O film should be limited in a range of from 0.004 to 0.9.

When the ratio of Zn content (wt. %) to the sum of Fe content (wt. %), Ni content (wt. %), and Zn content (wt. %) in the Fe—Ni—Zn—O film, (hereinafter referred to simply as "Zn/(Fe+Ni+Zn)"), is more than 0.6, the amount of Zn oxide which is inferior in adhesiveness to that of Fe oxide becomes too large, thus resulting in no effect of improvement of adhesiveness, and degrading the press-formability. Therefore, Zn/(Fe+Ni+Zn) in the Fe—Ni—Zn—O film should be limited to 0.6 or less.

Even when the Fe—Ni—Zn—O film is the one that is described above, if a metallic element such as metallic Ni and metallic Zn exists in a part of the surface thereof, the above-described effect of improvement of adhesiveness decreases. Therefore, the surface layer of the film is limited to an oxide layer consisting of an oxide or both of an oxide and a hydroxide of Fe, Ni, and Zn.

When the thickness of the oxide layer of the surface layer part in the Fe—Ni—Zn—O film is less than 0.5 nanometer, a metallic element such as metallic Ni and metallic Zn exist in a part of the surface of above-described oxide layer, thus decreasing the effect of improvement of press-formability and adhesiveness. On the other hand, if the thickness of the above-described oxide layer exceeds 50 nanometer, adhesion fracture of oxide layer occurs, thus degrading the press-formability.

Consequently, the thickness of the oxide film of the surface layer part in the Fe—Ni—Zn—O film formed on the surface of coating layer of the zinciferous coated steel sheet should be limited in a range of from 0.5 to 50 nanometer.

As described before, the formation of the Fe—Ni—Zn—O film and the formation of the oxide layer within a range of from 0.5 to 50 nanometer at the surface layer part in the film improve the press-formability and the adhesiveness of zinciferous coated steel sheet.

Furthermore, an increase of the coating weight of Fe—Ni—Zn—O film to a level of 10 $mg/m^2$ or more as a converted amount of the sum of metals in the film further improves the press-formability and the adhesiveness, and ensures excellent chemical treatability and spot-weldability. When, however, the coating weight exceeds 2500 $mg/m^2$, the effect of improvement of press-formability and the adhesiveness saturate, and the growth of phosphoric acid crystals is suppressed to degrade the chemical treatability.

Accordingly, for assuring excellent spot-weldability as well as excellent press-formability and adhesiveness, the coating weight of Fe—Ni—Zn—O film is preferably selected to 10 $mg/m^2$ or more, and for assuring excellent chemical treatability and spot-weldability, the coating weight thereof is preferably selected in a range of from 10 to 2500 $mg/m^2$.

The method for determining the thickness and the composition of the Fe—Ni—Zn—O film, and the thickness of the oxide layer of the surface layer in the Fe—Ni—Zn—O film may be the Auger electron spectroscopy (AES) combined with the Ar ion sputtering to conduct an analysis starting from the surface to the deeper zone.

That is, after sputtering to a specific depth, the content of individual elements at each depth is determined by applying a relative sensitivity parameter correction based on the spectral intensity of each target element. By repeating the analysis starting from the surface, the composition distribution of individual elements along the depth in the coating film is determined. According to the measurement, the amount of oxide or hydroxide reaches a maximum value at a certain depth, then decreases to approach to a constant level. The thickness of the oxide layer of the surface layer in the Fe—Ni—Zn—O film was selected as a depth giving half of the sum of the maximum concentration and the constant concentration level in a deeper portion than the maximum concentration point.

The zinciferous coated steel sheet according to the present invention may be a steel sheet that forms a zinc or zinc alloy coating layer on the surface thereof by the hot-dip coating method, electroplating method, chemical vapor deposition method, or the like. The zinc or zinc alloy coating layer is made of a single phase coating layer or of a multiple phase coating layer that contains pure Zn, and one or more of metals or their oxides or their organic compounds selected from the group of Fe, Cr, Co, Ni, Mn, Mo, Al, Ti, Si, W, Sn, Pb, Nb, and Ta, and the like. The coating layer may further contain fine particles of $SiO_2$, $Al_2O_3$, and the like. Furthermore, the zinciferous coated steel sheet may be a multiple-layer coating steel sheet in which each layer has a different composition with the same ingredient elements to each other, or a functionally gradient coating steel sheet which gives a varied composition in the coating layer with the same ingredient elements, may be used.

The Fe—Ni—Zn—O film according to the present invention may further contain Fe and Zn which exist in a form of a metal element, adding to an oxide and a hydroxide of metallic Ni, Fe, and Zn, and may further contain ingredient elements in the lower layer, or zinc or a zinc alloy coating layer, and elements unavoidably contained therein, for example Cr, Co, Mn, Mo, Al, Ti, Si, W, Sn, Pb, Nb, and Ta, in a form of an oxide and hydroxide and/or metallic element. Also in these cases, the above-described effect of Fe—Ni—Zn—O film is obtained.

The oxide layer according to the present invention may contain oxide or hydroxide of the ingredient elements described above being contained unavoidably in the Fe—Ni—Zn—O film.

Since the Fe—Ni—Zn—O film is formed on the surface of the coating layer on at least one side of the zinciferous coated steel sheet, an arbitrary stage in the car-body manufacturing line can adopt either one of the molded steel sheets formed on one side or on both sides depending on the use parts of the steel sheet in a car-body.

The method for forming a Fe—Ni—Zn—O film according to the present invention is not specifically limited, and various kinds of methods can be applied, for example, replacement coating using an aqueous solution containing a specified chemical composition, electroplating, immersion using an aqueous solution containing an oxidizing agent, cathodic electrolysis or anodic electrolysis in an aqueous solution containing an oxidizing agent, spraying or roll coating of aqueous solution containing a specified chemical composition, and vapor phase coating such as laser CVD, photo CVD, vacuum vapor deposition, and sputter deposition.

Formation of a Fe—Ni—Zn—O film according to the present invention is conducted by an immersion process or cathodic electrolysis may be carried out using the following-described method. That is, immersion treatment in an aqueous solution of hydrogen chloride containing 0.1 mol/l or more of the sum of $Ni^{2+}$, $Fe^{2+}$, and $Zn^{2+}$ ions, giving a temperature ranging from 40 to 70° C., and pH ranging from 2.0 to 4.0, for a period of from 5 to 50 seconds, or by an electrolysis in a plating bath containing nickel sulfate, ferrous sulfate, and zinc sulfate, under a condition of 0.1 to 2.0 mol/liter of the sum of $Ni^{2+}$, $Fe^{2+}$, and $Zn^{2+}$ ions and 1.0 to 3.0 of pH value. In addition, after forming the Fe—Ni—Zn—O film, the steel sheet is immersed in an aqueous solution containing an oxidizing agent such as hydrogen peroxide, potassium permanganate, nitric acid, and nitrous acid to form the oxide layer according to the present invention onto the surface layer part in the Fe—Ni—Zn—O film.

EXAMPLE (1) Sample Preparation

First, zinc or zinc coated steel sheets (hereinafter referred to as "base sheets") before forming Fe—Ni—Zn—O film were prepared. The prepared base sheets were three kinds of coating types each having a thickness of 0.8 mm. Each of the sheets was identified by the reference symbols given below depending on the coating method, coating composition, and coating weight.

GA: Alloyed zinc hot dip coated steel sheet (10 wt. % Fe, balance of Zn), with 60 g/$m^2$ of coating weight on each side.

GI: Zinc hot dip coating steel sheet, with 90 g/$m^2$ of coating weight on each side.

EG: Zinc electroplated steel sheet, with 40 g/$m^2$ of coating weight on each side.

An Fe—Ni—Zn—O film was formed on thus prepared zinciferous coated steel sheet by immersing in an aqueous solution of hydrogen chloride and by applying cathodic electrolysis.

Regarding the immersion treatment, the zinciferous coated steel sheet prepared was immersed in an aqueous solution of hydrogen chloride containing 0.5 to 2.0 mol/liter of the sum of $Ni^{2+}$, $Fe^{2+}$, and $Zn^{2+}$ ions, at 2.5 of pH value and 50 to 60° C. of liquid temperature for 5 to 20 seconds to form the Fe—Ni—Zn—O film. The Fe, Ni, and Zn composition in the Fe—Ni—Zn—O film was varied by changing the ion concentration ratio of $Ni^{2+}$, $Fe^{2+}$, and $Zn^{2+}$ ions in the aqueous solution, and the coating weight was varied by changing the immersion time.

As for the cathodic electrolysis, electrolysis was carried out in a coating bath containing nickel sulfate, ferrous sulfate, and zinc sulfate, and containing 0.1 to 2.0 mol/liter of the sum of $Ni^{2+}$, $Fe^{2+}$, and $Zn^{2+}$ ions, at 1.0 to 3.0 of pH value under a condition of 1 to 150 mA/$dm^2$ of current density and 30 to 70° C. of liquid temperature to form the Fe—Ni—Zn—O film. The Fe, Ni, and Zn composition in the Fe—Ni—Zn—O film was varied by changing the ion concentration ratio of $Ni^{2+}$, $Fe^{2+}$, and $Zn^{2+}$ ions in the coating bath, and the coating weight was varied by changing the electrolysis time.

Furthermore, the zinciferous coated steel sheet on which the Fe—Ni—Zn—O film was formed was immersed in an aqueous solution containing hydrogen peroxide as the oxidizing agent to form oxide layer on the surface layer part in Fe—Ni—Zn—O film. The thickness of the oxide layer was adjusted by changing the immersion time.

With thus prepared each zinciferous coated steel sheet, determination was given in terms of the thickness of oxide layer of surface layer in the Fe—Ni—Zn—O film, the composition and the coating weight of the Fe—Ni—Zn—O film. In addition, press-formabililty, adhesiveness, spot-weldability, and chemical treatability were evaluated.

The press-formability was evaluated by the friction factor between the specimen and the bead of press machine. The adhesiveness was evaluated by the peel strength. The spot-weldability was evaluated by the number of continuous welding spots of spot welding. The chemical treatability was evaluated by the state of zinc phosphate film crystals formed.

For reference, similar evaluations were given to a steel sheet that was not subjected to the film formation.

Detailed description of measurement and of evaluation tests are described below. The obtained results are listed in Table 1.

TABLE 1

| No. | Coating type | Preparation method | Fe—Ni—Zn—O film: Thickness of oxide film (nm) | Coating weight of film (Fe + Ni + Zn] mg/m$^2$ | Zn ratio Zn/(Fe + Ni + Zn) | Fe ratio Fe/(Fe + Ni + Zn) | Press-formability Friction factor $\mu$ | Adhesiveness Adhesion strength kgf/25 mm | Weldability Continuous spot weldability | Chemical treatability State of crystals in film |
|---|---|---|---|---|---|---|---|---|---|---|
| Example specimen according to the present invention | | | | | | | | | | |
| 1 | GA | Electrolysis | 1.4 | 1500 | 0.12 | 0.245 | 0.134 | 12.5 | ◎ | ○ |
| 2 | GA | Electrolysis | 2.8 | 600 | 0.08 | 0.073 | 0.130 | 9.9 | ◎ | ○ |
| 3 | GA | Electrolysis | 4.2 | 300 | 0.16 | 0.211 | 0.1336 | 12.2 | ◎ | ○ |
| 4 | GA | Immersion | 6.9 | 3250 | 0.40 | 0.227 | 0.131 | 11.2 | ◎ | X |
| 5 | GA | Electrolysis | 11.1 | 600 | 0.18 | 0.206 | 0.136 | 12.8 | ◎ | ○ |
| 6 | GA | Electrolysis | 11.1 | 2200 | 0.37 | 0.266 | 0.135 | 12.5 | ◎ | ○ |
| 7 | GA | Electrolysis | 12.0 | 1250 | 0.20 | 0.600 | 0.134 | 12.6 | ○ | ○ |
| 8 | GA | Electrolysis | 15.0 | 500 | 0.20 | 0.400 | 0.129 | 12.5 | ○ | ○ |
| 9 | GA | Immersion | 15.2 | 700 | 0.28 | 0.007 | 0.135 | 10.3 | ◎ | ○ |
| 10 | GA | Electrolysis | 19.4 | 1100 | 0.59 | 0.097 | 0.136 | 10.7 | ◎ | ○ |
| 11 | GA | Electrolysis | 23.5 | 1550 | 0.45 | 0.172 | 0.124 | 11.3 | ◎ | ○ |
| 12 | GA | Electrolysis | 26.3 | 550 | 0.35 | 0.182 | 0.121 | 12.5 | ◎ | ○ |
| 13 | GA | Immersion | 43.2 | 3500 | 0.26 | 0.230 | 0.098 | 12.5 | ○ | X |
| 14 | GA | Immersion | 45.7 | 500 | 0.34 | 0.053 | 0.129 | 11.9 | ◎ | ○ |
| 15 | EG | Immersion | 8.3 | 1250 | 0.24 | 0.106 | 0.129 | 12.1 | ○ | ○ |
| 16 | EG | Immersion | 41.0 | 800 | 0.49 | 0.113 | 0.131 | 11.9 | ○ | ○ |
| 17 | EG | Electrolysis | 2.1 | 100 | 0.48 | 0.047 | 0.130 | 10.3 | ○ | ○ |
| 18 | EG | Electrolysis | 13.8 | 550 | 0.37 | 0.069 | 0.132 | 11.00 | ○ | ○ |
| 19 | EG | Electrolysis | 19.4 | 1150 | 0.44 | 0.124 | 0.130 | 11.9 | ○ | ○ |
| 20 | EG | Immersion | 22.5 | 450 | 0.47 | 0.064 | 0.126 | 11.4 | ○ | ○ |
| 21 | EG | Immersion | 31.8 | 1800 | 0.11 | 0.231 | 0.113 | 12.00 | ○ | ○ |
| Comparative Example specimen | | | | | | | | | | |
| 22 | GA | — | — | — | — | — | 0.187 | 5.6 | Δ | ○ |
| 23 | GI | — | — | — | — | — | 0.205 | 3.5 | x | ○ |
| 24 | EG | — | — | — | — | — | 0.223 | 4.1 | Δ | ○ |
| 25 | GA | Electrolysis | 0.4 | 800 | 0.62 | 0.138 | 0.177 | 7.1 | ◎ | ○ |
| 26 | GA | Electrolysis | 15.3 | 300 | 0.32 | 0.001 | 0.129 | 7.2 | Δ | ○ |
| 27 | GA | Electrolysis | 15.4 | 700 | 0.71 | 0.001 | 0.148 | 6.5 | ◎ | ○ |
| 28 | GA | Electrolysis | 16.8 | 2050 | 0.87 | 0.029 | 0.143 | 7.5 | ◎ | ○ |
| 29 | GA | Immersion | 60.0 | 300 | 0.25 | 0.112 | 0.165 | 12.5 | ◎ | ○ |
| 30 | EG | Immersion | 0.4 | 500 | 0.21 | 0.166 | 0.175 | 7.2 | ○ | ○ |
| 31 | EG | Electrolysis | 4.6 | 50 | 0.80 | 0.040 | 0.186 | 7.0 | x | ○ |
| 32 | EG | Immersion | 70.0 | 850 | 0.63 | 0.049 | 0.180 | 8.1 | ○ | ○ |

In Table 1, the specimens Nos. 1 through 21 are zinciferous coated steel sheets within the specified range of the present invention, (hereinafter referred to simply as "Example specimens"), and the specimens Nos. 22 through 32 are zinc or zinc alloy steel sheets outside of the specified range of the present invention, (hereinafter referred to simply as "Comparative Example specimens)").

(2) Determination of the Thickness of the Oxide Layer of the Surface Layer in Fe—Ni—Zn—O Film, and Determination of Composition and Coating Weight of Fe—Ni—Zn—O Film Using the combination of the ICP method, Ar ion sputtering method, and AES method, the thickness of the oxide layer of the surface layer in Fe—Ni—Zn—O film, the composition and coating weight of Fe—Ni—Zn—O film were determined in the following procedure.

The ICP method cannot completely separate the ingredient elements between those in the upper layer, or the Fe—Ni—Zn—O film, from those in the lower layer, or the coating layer, for the case that the ingredient elements are the same for the upper layer, or the Fe—Ni—Zn—O film, and the lower layer, or the coating layer. Accordingly, the ICP method was applied to quantitatively determine Ni which was not included in the lower layer, or the coating layer, in the Fe—Ni—Zn—O film, thus determined the coating weight.

After applying Ar ion sputtering to a specified depth below the surface of a specimen, the ABS method was applied to repeat the determination of individual elements in the film, thus determining the composition distribution of elements in depth direction in the Fe—Ni—Zn—O film. According to the determination process, the amount of oxygen generated from oxide or hydroxide reaches a maximum level followed by reducing to approach to a constant level. The thickness of the oxide layer was selected as a depth giving half of the sum of the maximum concentration and the constant concentration level in a deeper portion than the maximum concentration point. The reference specimen used for determining the sputtering rate was $SiO_2$. The determined sputtering rate was 4.5 nm/min.

(3) Determination of Friction Factor

To evaluate the press-formability, friction factor of each specimen was determined using a device described below.

Figure 2:
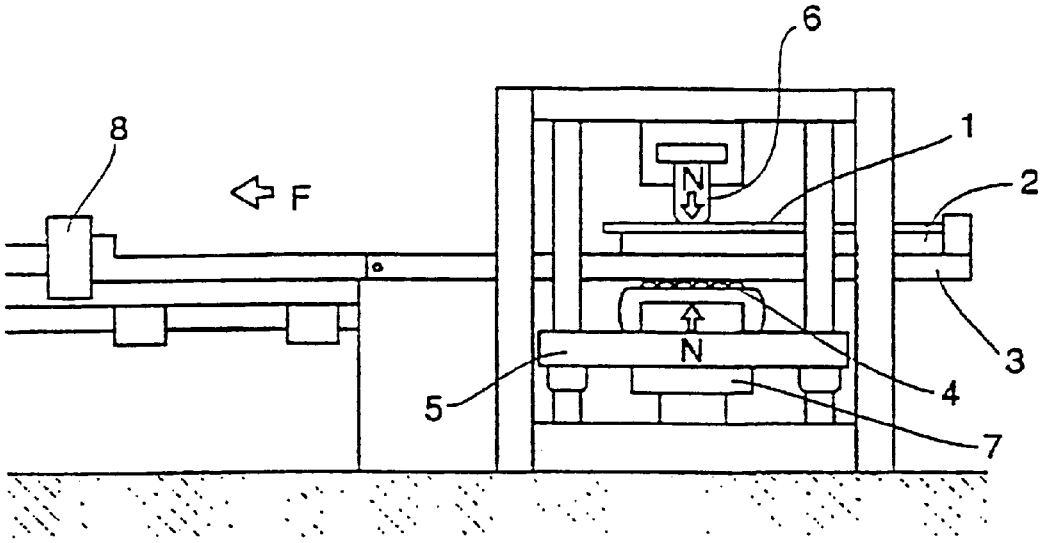
FIG. 2 is a schematic drawing of a friction tester.

FIG. 2 shows a schematic drawing of the friction tester depicting the side view thereof. As seen in the figure, a test piece 1 which was cut from a specimen is fixed to a test piece holder 2. The holder 2 is fixed onto the upper face of a slide table 3 which is movable in horizontal plane. At the lower face of the slide table 3, there is located a slide table support 5 which has a roller 4 contacting the slide table support 5 and which is movable in vertical plane. A first load cell 7 is attached to the slide table support 5, which first load cell 7 determines the pressing load N of a bead 6 against the test piece 1. A second load cell 8 is attached to one end of the slide table 3 in a horizontal moving direction to determine the sliding resistance F against the horizontal movement of the slide table 3 in a horizontal direction in a state that the above-described pressing force N is applied.

As a lubricant, "NOX RUST 550 HN" made by Nihon Perkerizing Co., Ltd. was applied onto the surface of the test piece 1 before testing.

The friction factor $\mu$ between the test piece and the bead was computed by the equation of $\mu$=F/N. The pressing force N was selected to 400 kgf, and the draw-off speed of the test piece (the horizontal moving speed of the slide table 3) was selected to 100 cm/min.

Figure 3:
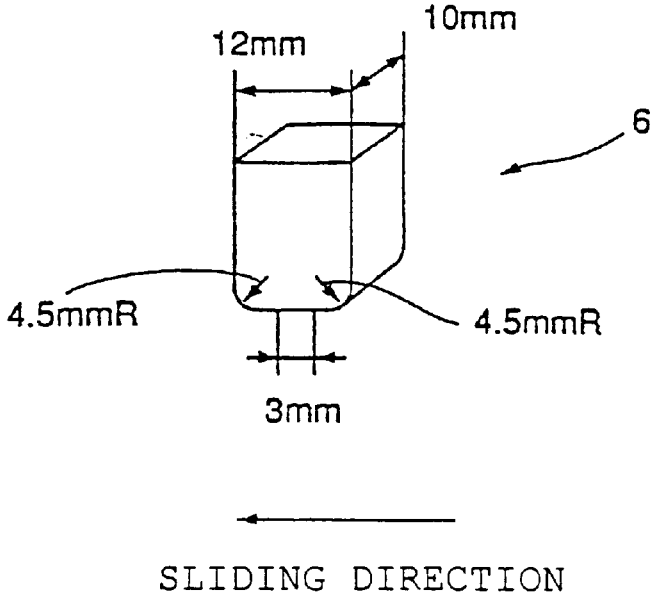
FIG. 3 is a schematic perspective view of the bead illustrating the shape and dimensions used in the friction tester given in FIG. 2.

FIG. 3 shows a schematic perspective view of the bead illustrating the shape and dimensions thereof. The test piece 1 moves in a state that the lower face of the bead 6 is pressed against the surface of the test piece 1. As seen in FIG. 3, the bead 6 has dimensions of 12 mm in length along sliding direction and 10 mm in width. The lower face of the bead has a flat plane having 3 mm in length along the sliding direction. To each of the front and rear sides, there is a curved face having 4.5 mm of radius.

(4) Adhesiveness Test

From each specimen, the following-described test piece for an adhesiveness test was prepared, and peel strength was determined.

Figure 4:
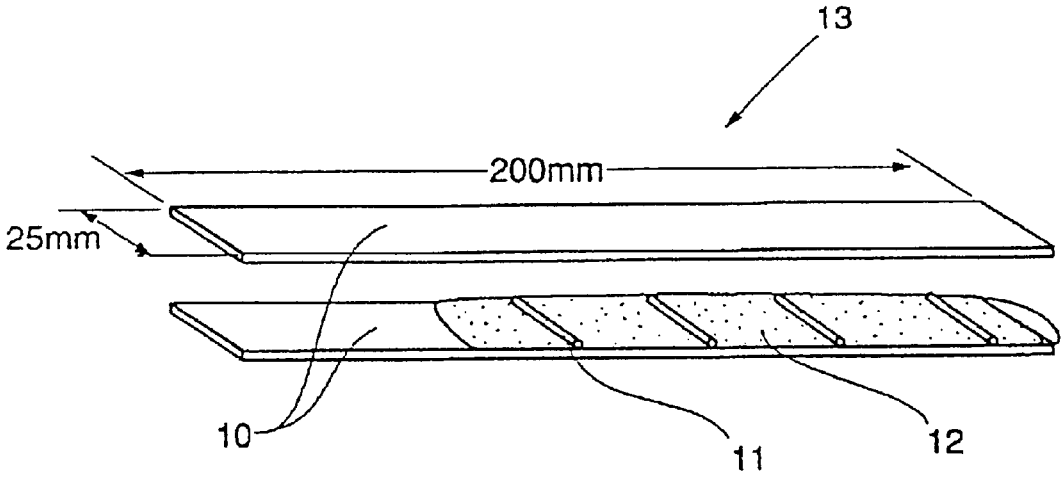
FIG. 4 is a schematic perspective view illustrating the assembling process of a test piece.
Figure 5:
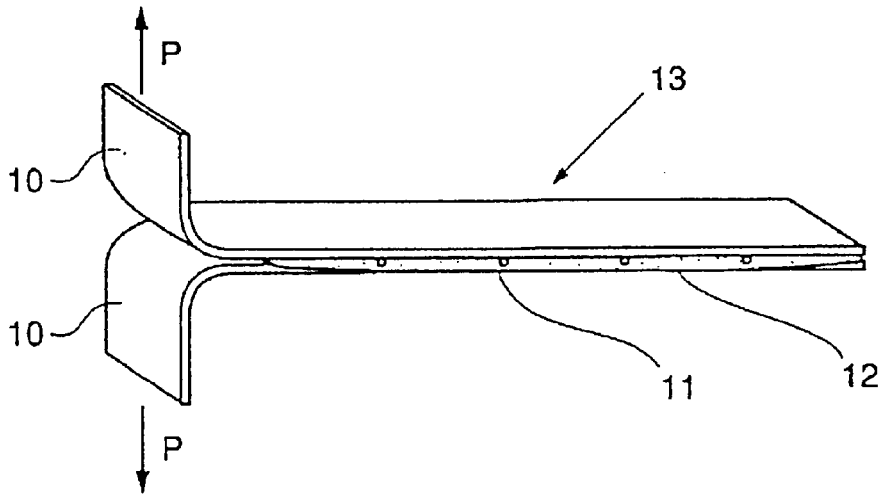
FIG. 5 is a schematic perspective view illustrating the tensile load for determining the peel strength in adhesiveness test.

FIG. 4 shows a schematic perspective view illustrating the assembling process of the test piece for the adhesiveness test. As shown in FIG. 4, two sheets of specimens 10 each having 25 mm of width and 200 mm of length were overlaid to each other while inserting a spacer 11 having 0.15 mm of thickness therebetween and adjusting the thickness of an adhesive 12 to 0.15 mm to adhere them together, thus obtaining the test piece 13. The prepared test piece 13 was subjected to baking at 150° C. for 10 minutes. Thus prepared test piece 13 was bent in a T-shape as shown in FIG. 5. The bent ends of the T-shaped test piece 13 were pulled to opposite directions to each other at a drawing speed of 200 mm/min. using a tensile tester. The average peeling strength was determined as the sheets of the test piece were peeled off from each other (n=3). As for the peeling strength, an average load was determined from the load chart of a tensile load curve at the peeled off point, and the result was expressed by a unit of kgf/25 mm. The symbol P in FIG. 5 designates the tensile load. The adhesive agent applied was a vinyl chloride resin type adhesive for hemflange adhesion. The peel strength of 9.5 kgf/25 mm or more provides favorable adhesiveness.

(5) Continuous Spot Weldability Test

To evaluate the spot-weldability, a continuous spot weldability test was performed on each specimen.

Two sheets of specimens having the same dimensions to each other were laminated together. A pair of electrode chips sandwiched the laminated specimens from top and bottom sides. Then electric power was applied to the specimens under a pressing force to focus the current on a spot to conduct continuous resistance welding (spot welding) under the condition given below.

Electrode chip: Dome shape having 6 mm of tip diameter
Pressing force: 250 kgf
Welding time: 12 cycles
Welding current: 11.0 kA
Welding speed: 1 point/sec The evaluation of continuous spot weldability was given by the number of continuous welding spots until the diameter of a melted-solidified metallic part (flat-disk shape, hereinafter referred to simply as "nugget") generated at the joint of overlaid two welding base sheets (specimens) becomes less than $4\times t^{1/2}$ (t is the thickness of a single plate). The number of continuous welding spots is referred to as the electrode life. When the electrode life was 5000 spots or more, the evaluation was given to [◎], when it was 3000 spots or more, the evaluation was given to [○], when it was 1500 spots or more, the evaluation was given to [Δ], and when it was less than 1500 spots, the evaluation was given to [x].

(6) Chemical Treatability

The following-described test was conducted to evaluate the chemical treatability.

Each specimen was treated by an immersion type zinc phosphate processing liquid for surface treatment of automobile painting (PBL3080, manufactured by Nihon Perkerizing Co., Ltd.) under an ordinary condition. A zinc phosphate film was formed on the processed surface of the specimen. Thus formed zinc phosphate film was observed under a scanning electron microscope (SEM). The specimen on which normal zinc phosphate film was formed was evaluated to [○], and the specimen on which no zinc phosphate film was formed or the specimen having void in crystals was evaluated to [x].

The result is listed in Table 1, which derived the following.

As for Comparative Examples which are outside of the specified range of the present invention, the following was revealed.

1) The specimens on which no Fe—Ni—Zn—O film is formed are poor in press-formability and adhesiveness for all types of coatings: GA, EG, and GI. (Refer to Comparative Example specimens No. 22 through 24.)

2) Even when an oxide layer of the surface layer part in Fe—Ni—Zn—O film is formed, if the thickness thereof is thinner than the specified range of the present invention, or if the thickness of the oxide layer is thinner than the specified range of the present invention and if the ratio Zn/(Fe+Ni+Zn) is larger than the specified range of the present invention, then the press-formability and the adhesiveness are poor. (Refer to Comparative Example specimens No. 25 and 30.)

3) Even when an oxide layer of the surface layer part in Fe—Ni—Zn—O film is formed, if the thickness thereof is thicker than the specified range of the present invention, or if the thickness of the oxide layer is thicker than the specified range of the present invention and if the ratio Zn/(Fe+Ni+Zn) is larger than the specified range of the present invention, then no effect of improvement of the press-formability is attained. (Refer to Comparative Example specimens No. 29 and 32.)

4) When the thickness of oxide layer of the surface layer part in Fe—Ni—Zn—O film is within the specified range of the present invention but when the ratio Fe/(Fe+Ni+Zn) is less than the specified range of the present invention, then the adhesiveness is poor. (Refer to Comparative Example specimen No. 26.)

5) When the thickness of oxide layer of the surface layer part in Fe—Ni—Zn—O film is within the specified range of the present invention but when the ratio Zn/(Fe+Ni+Zn) is larger than the specified range of the present invention, then the press-formability and the adhesiveness are poor. (Refer to Comparative Example specimens No. 28 and 31.)

6) When the thickness of oxide layer of the surface layer part in Fe—Ni—Zn—O film is within the specified range of the present invention but when the ratio Zn/(Fe+Ni+Zn) is larger than the specified range of the present invention and the ratio Fe/(Fe+Ni+Zn) is less than the specified range of the present invention, then the press-formability and the adhesiveness are poor. (Refer to Comparative Example specimen No. 27.)

To the contrary, all the Example specimens within the specified range of the present invention show excellent press-formability and adhesiveness in any coating type (GA, EG, and GI). (Refer to Example specimens Nos. 1 through 21.) Among them, the Example specimens which have 10 to 2500 mg/m$^2$ of the coating weight of Fe—Ni—Zn—O film give excellent spot-weldability and chemical treatability. The Example specimens which have over 2500 mg/m$^2$ of coating weight of Fe—Ni—Zn—O film show excellent spot-weldability, though the chemical treatability is inferior.

Embodiment 2

The inventors of the present invention found that the formation of an adequate Fe—Ni—Zn film on the surface of the coating layer on a zinciferous coated steel sheet significantly improves the press-formability, spot-weldability, and adhesiveness.

Regarding the "adequate Fe—Ni—Zn film", the inventors has identified that the film satisfies the following-listed requirements (1) through (5).

(1) Deeper layer part of the film is a metallic layer consisting of Fe, Ni, and Zn; Surface layer part of the film consists of an oxide and a hydroxide of Fe, Ni, and Zn, (hereinafter the surface layer part is referred to as "the oxide layer").

(2) Sum of Fe content and Ni content in the film is in a range of from 10 to 1500 mg/m$^2$.

(3) Ratio of Fe content (mg/m$^2$) to the sum of Fe content and Ni content (mg/m$^2$) in the film, or Fe/(Fe+Ni), is in a range of from 0.1 to 0.8.

(4) Ratio of Zn content (mg/m$^2$) to the sum of Fe content and Ni content (mg/m$^2$) in the film, or Zn/(Fe+Ni), is 1.6 or less, while excluding the case of Zn/(Fe+Ni)=0 because the film contains Zn.

(5) Thickness of the oxide layer in the film surface layer part is in a range of from 4 to 50 nm.

The cause of inferiority of press-formability of zinciferous coated steel sheet compared with that of cold-rolled steel sheet is the increase in sliding resistance resulting from adhesion phenomenon between the mold and the zinc having a low melting point under high pressure condition. The inventors considered that it is effective to form a film having higher hardness than zinc or zinc alloy coating layer and having higher melting point than thereof on the surface of coating layer of zinciferous coated steel sheet. Based on this consideration, the inventors have derived a finding that the formation of an adequate Fe—Ni—Zn film on the surface of zinciferous coated steel sheet decreases the sliding resistance between the surface of coating layer and the press mold during press-forming operation, thus improving the press-formnability. The reason for the reduction of sliding resistance is presumably that the Fe—Ni—Z film is hard and that the oxide layer existing in the surface layer part of the film has high melting point so that the film hardly generates adhesion with the mold during press-forming operation.

The reason of inferiority of zinciferous coated steel sheet in continuous spot weldability compared with that of cold-rolled steel sheet is the formation of a brittle alloy layer caused by the contact between the molten zinc with the copper of electrode during welding operation, which enhances degradation of electrode. To improve the spot-weldability, the inventors investigated various kinds of films, and found that a metallic layer consisting of Fe, Ni, and Zn is particularly effective. The reason for the effectiveness is not fully analyzed, but the presumable reason is high melting point of the metallic film consisting of Fe, Ni, and Zn, and also is high electric conductivity. Since the Fe—Ni—Zn layer according to the present invention has the lower layer part made of a metallic layer consisting of Fe, Ni, and Zn, the superior continuous spot weldability is attained. The Fe—Ni—Zn film according to the present invention has an oxide layer having low electric conductivity in the surface layer thereof, and the bad influence to the continuous spot weldability is avoided by controlling the thickness of the oxide layer.

It is known that the adhesiveness of zinciferous coated steel sheets is inferior to that of cold-rolled steel sheets. The cause was, however, not known. To this point, the inventors have found that excellent adhesiveness is attained by forming an Fe—Ni—Zn film in which the Fe content is adequately controlled onto the surface of zinciferous coated steel sheet.

The present invention has been derived based on the above-described findings, and the present invention provides a method to manufacture zinciferous coated steel sheets having excellent press-formability, spot-weldability, and adhesiveness by forming an Fe—Ni—Zn film on the surface of the zinciferous coated steel sheet. The aspect of the present invention is described below.

A method for producing a zinciferous coated steel sheet comprising the steps of: (a) providing an electrolyte of an acidic sulfate aqueous solution; (b) carrying out an electrolysis treatment in the electrolyte using a zinciferous coated steel sheet as a cathode under a current density ranging from 1 to 150 A/dm$^2$; and (c) carrying out an oxidation treatment to a surface of the zinciferous coated steel sheet to which the electrolysis treatment was carried out.

The acidic sulfate aqueous solution contains $Fe^{2+}$ ion, $Ni^{2+}$ ion and $Zn^{2+}$ ion. A total concentration of $Fe^{2+}$ ion and $Ni^{2+}$ ion is 0.3 to 2.0 mol/liter. A concentration of $Fe^{2+}$ ion is 0.02 to 1 mol/liter and a concentration of $Zn^{2+}$ ion is at most 0.5 mol/liter. The electrolyte has a pH of 1 to 3 and a temperature of 30 to 70° C. The oxidation treatment is carried out by applying a post-treatment to the zinciferous coated steel sheet in a post-treatment liquid having a pH of 3 to 5.5 for a treatment period of t (seconds) defined by the following formula:

$$50/T \leqq t \leqq 10$$

where, T denotes a temperature (° C.) of the post-treatment liquid.

The following is the reason for specifying the values of variables for manufacturing condition according to the present invention.

When the electrolyte contains less than 0.3 mol/liter of total concentration of $Fe^{2+}$ and $Ni^{2+}$ ions, burn of coating occurs to decrease the adhesiveness of Fe—Ni—Zn film, thus failing to obtain the effect of improvement in press-formability, spot-weldability, and adhesiveness. On the other hand, when the total concentration above-described exceeds 2.0 mol/liter, the solubility reaches the upper limit thereof, and, if temperature is low, precipitate of ferrous sulfate and zinc sulfate appears. Accordingly, the total concentration of $Fe^{2+}$ and $Ni^{2+}$ ions should be limited in a range of from 0.3 to 2.0 mol/liter.

Excellent adhesiveness is attained by forming an Fe—Ni—Zn film in which the Fe content is adequately controlled onto the surface of zinciferous coated steel sheet. When the $Fe^{2+}$ ion concentration is lower than 0.02 mol/liter, the ratio of Fe content ($mg/m^2$) to the sum of Fe content and Ni content ($mg/m^2$) in the film, or Fe/(Fe+Ni), cannot reach 0.1 or more, which results in insufficient effect of improvement of adhesiveness. When the $Fe^{2+}$ ion concentration in the electrolyte exceeds 1.0 mol/liter, the ratio of Fe content ($mg/m^2$) to the sum of Fe content and Ni content ($mg/m^2$) in the film, or Fe/(Fe+Ni), cannot be brought to 0.8 or less, which results in insufficient effect of improvement of spot-weldability. Consequently, the $Fe^{2+}$ ion concentration in the electrolyte should be limited in a range of from 0.02 to 1.0 mol/liter.

When the concentration of $Fe^{2+}$ ion in the electrolyte increases, the rate of formation of $Fe^{+3}$ ion increases owing to the oxidation by air or by anode. The $Fe^{3+}$ ion is readily converted to sludge of iron hydroxide. Therefore, in a bath with a high content of $Fe^{2+}$ ion, a large amount of sludge generates to adhere to the surface of zinciferous coated steel sheet, which then likely induces surface defects such as dents. In this respect, the concentration of $Fe^{2+}$ ion is preferably limited to 0.6 mol/liter or less.

Since an object of the present invention is to form an adequately controlled Fe—Ni—Zn film, the electrolyte has to contain $Zn^{2+}$ ion. When $Zn^{2+}$ ion concentration in the electrolyte exceeds 0.5 mol/liter, the effect of improvement of press-formability and spot-weldability become insufficient. Therefore, the concentration of $Zn^{2+}$ in the electrolyte should be limited in a range of from more than zero to not more than 0.5 mol/liter.

The electrolyte may further contain a pH buffer to improve the adhesiveness thereof. Examples of the pH buffer are boric acid, citric acid, acetic acid, oxalic acid, malonic acid, tartaric acid, salts thereof, and ammonium sulfate.

The electrolyte may further contain unavoidable cations such as those of Co, Mn, Mo, Al, Ti, Sn, W, Si, Pb, Nb, and Ta, hydroxides and oxides, and anions other than sulfate ion, which ions are included in the coating layer of zinciferous coated steel sheet used in the present invention.

When the pH value of electrolyte is less than 1, hydrogen generation becomes the main part of the cathode reaction, thus the current efficiency is significantly reduced. On the other hand, when the pH value exceeds 3, ferric hydroxide precipitates. Consequently, the pH value of electrolyte should be controlled within a range of from 1 to 3.

When the temperature of electrolyte is less than 30° C., burn of coating occurs to degrade the adhesiveness of Fe—Ni—Zn film, which fails to attain the effect of improvement of press-formability, spot-weldability, and adhesiveness. On the other hand, the temperature of electrolyte exceeds 70° C., evaporation of the electrolyte is enhanced, which makes the control of concentration of $Fe^{2+}$, $Ni^{2+}$, and $Zn^{2+}$ ions difficult. Therefore, the temperature of electrolyte should be limited in a range of from 30 to 70° C.

Regarding the current density for electrolysis, below 10 $A/dm^2$ of current density makes the hydrogen generation govern the anodic reaction, thus significantly reducing the current efficiency. On the other hand, if the current density exceeds 150 $A/dm^2$, burn of coating occurs to degrade the adhesiveness of Fe—Ni—Zn film, thus failing in attaining the effect of improvement of press-formability, spot-weldability, and adhesiveness. Accordingly, the current density of electrolysis should be limited in a range of from 10 to 150 $A/dm^2$.

The following is the reason for specifying the values of variables for post-treatment condition.

The effect of improvement of formability is drastically enhanced by selecting the thickness of oxide layer in the surface layer part of Fe—Ni—Zn film to 4 nanometer or more. On the other hand, since the oxide layer has high electric resistance, the spot-weldability degrades if the thickness thereof exceeds 50 nanometer. Consequently, the thickness of oxide layer in the surface layer part of Fe—Ni—Zn film should be limited in a range of from 4 to 50 nanometer. Nevertheless, the thickness of oxide layer in the surface layer part of Fe—Ni—Zn film obtained by the electrolysis described above is less than 4 nanometer.

To this point, the inventors conducted studies for developing post-treatment technology to attain 4 nanometer or thicker oxide layer in the surface layer part of Fe—Ni—Zn film, and found that the 4 nanometer or thicker oxide layer in the surface layer part of Fe—Ni—Zn film is obtained by applying immersion treatment or spray treatment using a post-treatment liquid having a pH range of from 3 to 5.5.

The mechanism of increasing the thickness of oxide layer in the surface layer part of Fe—Ni—Zn film through the post-treatment is presumably the following. When immersion treatment or spray treatment using a post-treatment liquid having a pH range of from 3 to 5.5 is applied, a Zn dissolving reaction (1), a Fe dissolving reaction (2) and a hydrogen generation reaction (3) simultaneously occur in the Fe—Ni—Zn layer and in the coating layer.

$$Zn \rightarrow Zn^{2+} + 2e^- \quad (1)$$

$$Fe \rightarrow Fe^{2+} + 2e^- \quad (2)$$

$$H^+ + e^- \rightarrow (1/2)H_2 \quad (3)$$

Since the reaction (3) consumes $H^+$ ion, the pH value of the post-treatment liquid increases in the vicinity of surface of the Fe—Ni—Zn film. As a result, once-dissolved $Zn^{2+}$ is caught by the Fe—Ni—Zn film in a form of hydroxide, which results in the increased thickness of the oxide layer.

The thickness of oxide layer does not increase during the post-treatment if the pH value of the post-treatment liquid is less than 3. The phenomenon presumably occurs from that, although the reactions (1) and (2) proceed, the pH value of the post-treatment liquid does not increase to a level that induces the generation of Zn hydroxide in the vicinity of the surface of Fe—Ni—Zn film. On the other hand, if the pH value of the post-treatment liquid exceeds 5.5, the effect of increase in the thickness of oxide layer is small presumably because the reaction rate of (1) and (2) becomes extremely slow. Therefore, the pH value of post-treatment liquid should be adjusted in a range of from 3 to 5.5.

The inventors conducted further study on the time of post-treatment, t(sec), necessary for forming the thickness of oxide layer in the surface layer part of Fe—Ni—Zn film to 4 nm or more, and found that the necessary time t strongly depends on the temperature, T (° C.), of the post-treatment and that increase in temperature, T, significantly shortens the necessary time, t. The post-treatment time, t(sec), necessary to obtain 4 nm or larger thickness of the oxide layer in the surface layer part of Fe—Ni—Zn film is expressed by:

$$t \geqq 50/T$$

When t is less than (50/T), the resulted thickness of the oxide layer becomes less than 4 nanometer, and the effect of improvement of press-formability is insufficient. From the viewpoint of productivity, however, the upper limit of the post-treatment time should be 10 seconds or less.

Accordingly, the necessary post-treatment time, t(sec), should be limited in a range of from (50/T) to 10 seconds.

The temperature of post-treatment liquid is not specifically limited. Nevertheless, higher temperature is more preferable from the standpoint of shortening of treatment time.

Spray treatment, immersion treatment, or the like may be applied as the post-treatment method. In the immersion treatment, the post-treatment liquid may be in a flowing mode.

The composition of post-treatment liquid is not specifically limited, and aqueous solution of various kinds of acids, aqueous solution prepared by diluting an electrolyte with water may be used.

The zinciferous coated steel sheet according to the present invention to use for forming an Fe—Ni—Zn film on the surface thereof may be a steel sheet that forms a zinc or zinc alloy coating layer on the surface thereof by hot-dip coating method, electroplating method, chemical vapor deposition method, or the like. The zinc or zinc alloy coating layer is made of a single phase coating layer or of multiple phase coating layer that contains pure Zn, and one or more of metals or their oxides or their organic compounds selected from the group of Fe, Ni, Co, Mn, Cr, Al, Mo, Ti, Si, W, Sn, Pb, Nb, and Ta, and the like, (wherein Si is dealt as a metal). The above-described coating layer may further contain fine particles of $SiO_2$, $Al_2O_3$, and the like. Furthermore, the zinciferous coated steel sheet may be a multiple-coating steel sheet or a functionally gradient coating steel sheet, which give varied composition in the coating layer, may be used.

EXAMPLE

As for the zinciferous coated steel sheets before forming the film by electrolysis used in the method according to the present invention and the comparative methods, either of GA, GI, and EG, specified below was applied.

GA: Alloyed zinc hot dip coated steel sheet (10 wt. % Fe, balance of Zn), with 60 g/m$^2$ of coating weight on each side.

GI: Zinc hot dip coating steel sheet, with 90 g/m$^2$ of coating weight on each side.

EG: Zinc electroplated steel sheet, with 40 g/m$^2$ of coating weight on each side.

To each of the above-described three kinds of zinciferous coated steel sheets, anodic electrolysis was carried out in an electrolyte of an acidic sulfate aqueous solution containing $Fe^{2+}$, $Ni^{2+}$, and $Zn^{2+}$ ions. Boric acid was added as pH buffer to the electrolyte. The electrolysis was carried out under a condition of varied variables of: concentration of ($Fe^{2+}$+$Ni^{2+}$+$Zn^{2+}$) in the electrolyte; pH value and temperature of the electrolyte; and current density, etc. Following the electrolysis, post-treatment was conducted. The post-treatment liquid applied was either of the electrolyte above-described diluted with water to a specific level, an aqueous solution of sulfuric acid, and an aqueous solution of hydrochloric acid, while changing pH value thereof and changing the time for post-treatment and other variables. In this manner, Fe—Ni—Zn film was formed on the surface of each zinciferous coated steel sheet.

Tables 2 through 6 show the detailed conditions for forming Fe—Ni—Zn film for Examples 1 through 25 which are the methods within the range of the present invention, and for Comparative

TABLE 2

| | | Conditions of electrolysis | | | | | | | | Conditions of post treatment | | | | |
|---|---|---|---|---|---|---|---|---|---|---|---|---|---|---|
| | | Electrolyte | | | | | | | | Post-treatment liquid | | | | |
| Test | Coating type | Composition | | $Fe^{2+}$ + $Ni^{2+}$ (mol/l) | pH | Temperature (° C.) | Liquid flow speed (m/s) | Current density (A/dm$^2$) | Coating Time (sec) | Composition | pH | Temperature T(50/T) | Treatment time t (sec) | Treatment method |
| Comparative Example 1 | GA | — | | — | — | — | — | — | — | — | — | — | — | — |
| Comparative Example 2 | | Nickel sulfate<br>Ferrous sulfate<br>Zinc sulfate<br>Boric acid | 1.8 mol/l<br>0.00 mol/l<br>0.05 mol/l<br>30 g/l | 1.8 | 2.0 | 50 | 2.0 | 10 | 2 folds. | The electrolyte given in the left column is diluted by water to 200 folds. | 4.2 | 80 (0.625) | 2 | Immersion treatment |
| Comparative Example 3 | | Nickel sulfate<br>Ferrous sulfate<br>Zinc sulfate<br>Boric acid | 1.8 mol/l<br>0.01 mol/l<br>0.05 mol/l<br>30 g/l | 1.81 | 2.0 | 50 | 2.0 | 10 | 2 folds. | The electrolyte given in the left column is diluted by water to 200 folds. | 4.2 | 80 (0.625) | 2 | Immersion treatment |
| Example 1 | | Nickel sulfate<br>Ferrous sulfate<br>Zinc sulfate<br>Boric acid | 1.8 mol/l<br>0.02 mol/l<br>0.05 mol/l<br>30 g/l | 1.82 | 2.0 | 50 | 2.0 | 10 | 2 folds. | The electrolyte given in the left column is diluted by water to 200 folds. | 4.2 | 80 (0.625) | 2 | Immersion treatment |
| Comparative 4 | | Nickel sulfate | 1.7 mol/l | 1.9 | 2.0 | 50 | 2.0 | 7 | 2 | — | — | — | 0 | — |
| Comparative 5 | | Ferrous sulfate | 0.2 mol/l | 1.9 | 2.0 | 50 | 2.0 | 10 | 2 | — | — | — | 0 | — |
| Comparative 6 | | Zinc sulfate | 0.05 mol/l | 1.9 | 2.0 | 50 | 2.0 | 50 | 0.5 | — | — | — | 0 | — |
| Comparative 7 | | Boric acid | 30 g/1 | 1.9 | 2.0 | 50 | 2.0 | 100 | 0.2 | — | — | — | 0 | — |
| Comparative 8 | | | | 1.9 | 2.0 | 50 | 2.0 | 140 | 0.2 | — | — | — | 0 | — |
| Comparative 9 | | | | 1.9 | 2.0 | 50 | 2.0 | 7 | 2 | The electrolyte given in the left column is diluted by water to 1000 folds. | 4.7 | 50(1) | 2 | Immersion treatment |
| Example 2 | | | | 1.9 | 2.0 | 50 | 2.0 | 10 | 2 | | 4.7 | 50(1) | 2 | |
| Example 3 | | | | 1.9 | 2.0 | 50 | 2.0 | 50 | 0.5 | | 4.7 | 50(1) | 2 | |
| Example 4 | | | | 1.9 | 2.0 | 50 | 2.0 | 100 | 0.2 | | 4.7 | 50(1) | 2 | |
| Example 5 | | | | 1.9 | 2.0 | 50 | 2.0 | 140 | 0.2 | | 4.7 | 50(1) | 2 | |
| Comparative 10 | | | | 1.9 | 2.0 | 50 | 2.0 | 170 | 0.2 | | 4.7 | 50(1) | 2 | |

TABLE 3

| | | Conditions of electrolysis | | | | | | | | | | | |
|---|---|---|---|---|---|---|---|---|---|---|---|---|---|
| | | Electrolyte | | | | | | | | Conditions of post treatment | | | |
| | | | | | | | | | | Post-treatment liquid | | | |
| Test | Coating type | Composition | | $Fe^{2+}$ + $Ni^{2+}$ (mol/l) | pH | Temperature (° C.) | Liquid flow speed (m/s) | Current density (A/dm$^2$) | Coating Time (sec) | Composition | pH | Temperature T(50/T) | Treatment time t (sec) | Treatment method |
| Example 6 | GA | Nickel sulfate<br>Ferrous sulfate<br>Zinc sulfate<br>Boric acid | 1.0 mol/l<br>1.0 mol/l<br>0.2 mol/l<br>30 g/l | 2.0 | 1.8 | 50 | 1.0 | 70 | 0.2 | The electrolyte given in the left column is diluted by water to 50 folds. | 3.2 | 80 (0.625) | 2 | Immersion treatment |
| Comparative 11 | | Nickel sulfate<br>Ferrous sulfate<br>Zinc sulfate<br>Boric acid | 0.5 mol/l<br>1.5 mol/l<br>0.2 mol/l<br>30 g/l | 2.0 | 1.8 | 50 | 1.0 | 70 | 0.2 | The electrolyte given in the left column is diluted by water to 50 folds. | 3.2 | 80 (0.625) | 2 | Immersion treatment |
| Example 7 | | Nickel sulfate<br>Ferrous sulfate<br>Zinc sulfate<br>Boric acid | 1.3 mol/l<br>0.2 mol/l<br>0.5 mol/l<br>30 g/l | 1.5 | 2.0 | 60 | 2.0 | 90 | 0.2 | The electrolyte given in the left column is diluted by water to 50 folds. | 3.2 | 80 (0.625) | 2 | Immersion treatment |
| Comparative 12 | | Nickel sulfate<br>Ferrous sulfate<br>Zinc sulfate<br>Boric acid | 1.3 mol/l<br>0.2 mol/l<br>1.0 mol/l<br>30 g/l | 1.5 | 2.0 | 60 | 2.0 | 90 | 0.2 | The electrolyte given in the left column is diluted by water to 50 folds. | 3.2 | 80 (0.625) | 2 | Immersion treatment |

TABLE 4

| | | Conditions of electrolysis | | | | | | | | | | | |
|---|---|---|---|---|---|---|---|---|---|---|---|---|---|
| | | Electrolyte | | | | | | | | Conditions of post treatment | | | |
| | | | | | | | | | | Post-treatment liquid | | | |
| Test | Coating type | Composition | | $Fe^{2+}$ + $Ni^{2+}$ (mol/l) | pH | Temperature (° C.) | Liquid flow speed (m/s) | Current density (A/dm$^2$) | Coating Time (sec) | Composition | pH | Temperature T(50/T) | Treatment time t (sec) | Treatment method |
| Comparative 13 | GA | Nickel sulfate<br>Ferrous sulfate<br>Zinc sulfate<br>Boric acid | 0.15 mol/l<br>0.03 mol/l<br>0.02 mol/l<br>30 g/l | 0.18 | 2.8 | 60 | 2.0 | 50 | 0.5 | Aqueous solution of sulfuric acid | 4.0 | 80 (0.625) | 1 | Immersion treatment |
| Example 8 | | Nickel sulfate<br>Ferrous sulfate<br>Zinc sulfate<br>Boric acid | 0.3 mol/l<br>0.06 mol/l<br>0.04 mol/l<br>30 g/l | 0.36 | 2.8 | 60 | 2.0 | 50 | 0.5 | Aqueous solution of sulfuric acid | 4.0 | 80 (0.625) | 1 | Immersion treatment |
| Comparative 14 | | Nickel sulfate<br>Ferrous sulfate<br>Zinc sulfate<br>Boric acid | 1.3 mol/l<br>0.2 mol/l<br>0.3 mol/l<br>30 g/l | 1.5 | 0.8 | 45 | 1.5 | 50 | 2 | Aqueous solution of hydrochloric acid | 3.5 | 25(2) | 2.5 | Spraying |
| Example 9 | | Nickel sulfate<br>Ferrous sulfate<br>Zinc sulfate<br>Boric acid | 1.3 mol/l<br>0.2 mol/l<br>0.3 mol/l<br>30 g/l | 1.5 | 1.2 | 45 | 1.5 | 50 | 2 | Aqueous solution of hydrochloric acid | 4.2 | 25(2) | 2.5 | Spraying |
| Comparative 15 | | Nickel sulfate<br>Ferrous sulfate<br>Zinc sulfate<br>Boric acid | 0.6 mol/l<br>0.1 mol/l<br>0.1 mol/l<br>30 g/l | 0.7 | 2.2 | 25 | 2.5 | 50 | 0.5 | The electrolyte given in the left column is diluted by water to 1000 folds. | 5.0 | 100 (0.5) | 1 | Spraying |

TABLE 5

| Test | Coating type | Conditions of electrolysis: Electrolyte: Composition | | $Fe^{2+}$ + $Ni^{2+}$ (mol/l) | pH | Temperature (° C.) | Liquid flow speed (m/s) | Current density (A/dm²) | Coating Time (sec) | Conditions of post treatment: Post-treatment liquid: Composition | pH | Temperature T(50/T) | Treatment time t (sec) | Treatment method |
|---|---|---|---|---|---|---|---|---|---|---|---|---|---|---|
| Example 10 | GA | Nickel sulfate<br>Ferrous sulfate<br>Zinc sulfate<br>Boric acid | 0.6 mol/l<br>0.1 mol/l<br>0.1 mol/l<br>30 g/l | 0.7 | 2.2 | 35 | 2.5 | 50 | 0.5 | The electrolyte given in the left column is diluted by water to 1000 folds. | 5.0 | 100 (0.5) | 1 | Spraying |
| Comparative 16 | | Nickel sulfate | 1.1 mol/l | 1.2 | 2.0 | 50 | 2.0 | 50 | 0.5 | Acidic sulfate aqueous solution | 2.5 | 40(1.25) | 1.5 | Immersion treatment |
| Comparative 17 | | Ferrous sulfate | 0.1 mol/l | 1.2 | 2.0 | 50 | 2.0 | 50 | 0.5 | | 2.5 | 40(1.25) | 5 | |
| Comparative 18 | | Zinc sulfate | 0.3 mol/l | 1.2 | 2.0 | 50 | 2.0 | 50 | 0.5 | | 3.0 | 40(1.25) | 0.5 | |
| Example 11 | | Boric acid | 30 g/l | 1.2 | 2.0 | 50 | 2.0 | 50 | 0.5 | | 3.0 | 40(1.25) | 1.5 | |
| Example 12 | | | | 1.2 | 2.0 | 50 | 2.0 | 50 | 0.5 | | 3.0 | 40(1.25) | 5 | |
| Comparative 19 | | | | 1.2 | 2.0 | 50 | 2.0 | 50 | 0.5 | | 4.0 | 40(1.25) | 0.5 | |
| Example 13 | | | | 1.2 | 2.0 | 50 | 2.0 | 50 | 0.5 | | 4.0 | 40(1.25) | 1.5 | |
| Example 14 | | | | 1.2 | 2.0 | 50 | 2.0 | 50 | 0.5 | | 4.0 | 40(1.25) | 5 | |
| Comparative 20 | | | | 1.2 | 2.0 | 50 | 2.0 | 50 | 0.5 | | 5.0 | 40(1.25) | 0.5 | |
| Example 15 | | | | 1.2 | 2.0 | 50 | 2.0 | 50 | 0.5 | | 5.0 | 40(1.25) | 1.5 | |
| Example 16 | | | | 1.2 | 2.0 | 50 | 2.0 | 50 | 0.5 | | 5.0 | 40(1.25) | 5 | |
| Comparative 21 | | | | 1.2 | 2.0 | 50 | 2.0 | 50 | 0.5 | | 5.7 | 40(1.25) | 1.5 | |
| Comparative 22 | | | | 1.2 | 2.0 | 50 | 2.0 | 50 | 0.5 | | 5.7 | 40(1.25) | 5 | |
| Comparative 23 | | | | 1.2 | 2.0 | 50 | 2.0 | 50 | 0.5 | | 5.5 | 80(0.625) | 0.5 | Immersion treatment |
| Example 17 | | | | 1.2 | 2.0 | 50 | 2.0 | 50 | 0.5 | | 5.5 | 80(0.625) | 0.7 | |
| Example 18 | | | | 1.2 | 2.0 | 50 | 2.0 | 50 | 0.5 | | 5.5 | 80(0.625) | 2 | |
| Example 19 | | | | 1.2 | 2.0 | 50 | 2.0 | 50 | 0.5 | | 5.5 | 80(0.625) | 5 | |
| Comparative 24 | | | | 1.2 | 2.0 | 50 | 2.0 | 50 | 0.5 | The electrolyte given in the left column is diluted by water to 5000 folds. | 5.5 | 20(2.5) | 2 | Immersion treatment |
| Example 20 | | | | 1.2 | 2.0 | 50 | 2.0 | 50 | 0.5 | | 5.5 | 20(2.5) | 3 | |
| Example 21 | | | | 1.2 | 2.0 | 50 | 2.0 | 50 | 0.5 | | 5.5 | 20(2.5) | 5 | |

TABLE 6

| Test | Coating type | Conditions of electrolysis: Electrolyte: Composition | | $Fe^{2+}$ + $Ni^{2+}$ (mol/l) | pH | Temperature (° C.) | Liquid flow speed (m/s) | Current density (A/dm²) | Coating Time (sec) | Conditions of post treatment: Post-treatment liquid: Composition | pH | Temperature T(50/T) | Treatment time t (sec) | Treatment method |
|---|---|---|---|---|---|---|---|---|---|---|---|---|---|---|
| Comparative 25 | GI | — | | — | — | — | — | — | — | — | — | — | — | — |
| Comparative 26 | | Nickel sulfate | 1.0 mol/l | 1.1 | 2.0 | 50 | 2.0 | 50 | 0.5 | The electrolyte given in the left column is diluted by water to 200 folds. | 4.0 | 30(1.67) | 0 | Immersion treatment |
| Example 22 | | Ferrous sulfate | 0.1 mol/l | 1.1 | 2.0 | 50 | 2.0 | 0 | 0.5 | | 4.0 | 30(1.67) | 2 | |
| Example 23 | | Zinc sulfate<br>Boric acid | 0.1 mol/l<br>30 g/l | 1.1 | 2.0 | 50 | 2.0 | 50 | 0.5 | | 4.0 | 30(1.67) | 5 | |
| Comparative 27 | EG | — | | — | — | — | — | — | — | — | — | — | — | — |
| Comparative 28 | | Nickel sulfate | 1.0 mol/l | 1.1 | 2.0 | 50 | 2.0 | 50 | 0.5 | The electrolyte given in the left column is diluted by water to 50 folds. | 3.2 | 75(0.67) | 0 | Immersion treatment |
| Example 24 | | Ferrous sulfate | 0.1 mol/l | 1.1 | 2.0 | 50 | 2.0 | 50 | 0.5 | | 3.2 | 75(0.67) | 1 | |
| Example 25 | | Zinc sulfate<br>Boric acid | 0.1 mol/l/<br>30 g/l | 1.1 | 2.0 | 50 | 2.0 | 50 | 0.5 | | 3.2 | 75(0.67) | 5 | |

Under the conditions given above, specimens were prepared from individual zinciferous coated steel sheets with Fe—Ni—Zn film formed thereon. Specimens were also prepared from the steel sheet which was not subjected to both the electrolysis treatment and the post-treatment, and from the steel sheet which was subjected to only the post-treatment. Thus prepared specimens underwent the analysis of Fe—Ni—Zn film, and the characteristics evaluation tests in terms of press-formability, spot-weldability, and adhesiveness for the zinciferous coated steel sheets with Fe—Ni—Zn film formed thereon. The applied analytical method and characteristics evaluation test method are the following.

(1) Analytical Method

"Sum of Fe content and Ni content ($mg/m^2$) in the film, Ratio of Fe/(Fe+Ni) ($mg/m^2$) in the film, and Ratio of Zn/(Fe+Ni) ($mg/m^2$) in the film"

Since the lower layer, or the coating layer, contains Fe and Zn among the ingredients of Fe—Ni—Zn film, ICP method is difficult to completely separate the elements in Fe—Ni—Zn film, or the upper layer, from the elements in the coating layer, or the lower layer. Accordingly, ICP method was applied to analyze quantitatively only Ni element which does not exist in the lower layer, or the coating layer. After applying Ar ion-sputtering, XPS method was applied to repeat the determination of individual elements in Fe—Ni—Zn film from the surface thereof, thus determining the composition distribution of individual elements in the depth direction vertical to the surface of Fe—Ni—Zn film. According to the method, the thickness of Fe—Ni—Zn film was defined by an average depth of the depth giving the maximum concentration of Ni element in the Fe—Ni—Zn film, which Ni element does not exist in the lower layer, or the coating layer, and the depth at which Ni element disappears. The coating weight and the composition of Fe—Ni—Zn film were computed from the results of the ICP method and the XPS method. Then, a computation was carried out to derive the sum of Fe content and Ni content ($mg/m^2$) in the film, the ratio of Fe/(Fe+Ni) ($mg/m^2$) in the film, and the ratio of Zn/(Fe+Ni) ($mg/m^2$) in the film.

"Thickness of oxide layer in the surface layer part of film"

The thickness of oxide layer in the surface layer part of Fe—Ni—Zn film was determined by a combination of Ar ion sputtering method with X-ray Photoelectron Spectroscopic method (XPS) or Auger electron spectroscopy (AES). That is, Ar ion sputtering was applied to a specific depth from the surface of a specimen, then XPS or AES was applied to determine individual elements in the film, and the processing was repeated. According to the determination process, the amount of oxygen generated from oxide or hydroxide reaches a maximum level followed by reducing to approach to a constant level. The thickness of the oxide layer was selected as a depth giving half of the sum of the maximum concentration and the constant concentration level in a deeper portion than the maximum concentration point. The reference specimen used for determining the sputtering rate was $SiO_2$. The determined sputtering rate was 4.5 nm/min.

(2) Characteristics Evaluation Tests

"Friction Factor Determination Test"

To evaluate the press-formability, friction factor of each specimen was determined using a device described in FIG. 2.

As a lubricant, "NOX RUST 550 HN" made by Nihon Perkerizing Co., Ltd. was applied onto the surface of the test piece 1 before testing.

The friction factor $\mu$ between the test piece and the bead was computed by the equation of $\mu$=F/N. The pressing force N was selected to 400 kgf, and the draw-off speed of the test piece (the horizontal moving speed of the slide table 3) was selected to 100 cm/min.

FIG. 3 shows a schematic perspective view of the bead illustrating the shape and dimensions thereof.

[Continuous Spot Weldability Test]

To evaluate the spot-weldability, continuous spot weldability test was given to each specimen. Two sheets of specimens having the same dimensions to each other were laminated together. A pair of electrode chips sandwiched the laminated specimens from top and bottom sides. Then electric power was applied to the specimens under a pressing force to focus the current on a spot to conduct continuous resistance welding (spot welding) under the condition given below.

Electrode chip: Dome shape having 6 mm of tip diameter

Pressing force: 250 kgf

Welding time: 0.2 second

Welding current: 11.0 kA

Welding speed: 1 point/sec

The evaluation of continuous spot weldability was given by the number of continuous welding spots until the diameter of melted-solidified metallic part (nugget) generated at the joint of overlaid two welding base sheets (specimens) becomes less than $4\times t^{1/2}$ (t is the thickness of a single plate, mm). The number of continuous welding spots is referred to hereinafter as the electrode life.

[Adhesiveness Test]

From each specimen, the following-described test piece for adhesiveness test was prepared.

FIG. 4 shows a schematic perspective view illustrating the assembling process of the test piece. Thus prepared test piece 13 was bent in the T-shape as shown in FIG. 5. The bent ends of T-shaped test piece were pulled to opposite directions to each other at a drawing speed of 200 mm/min. using a tensile tester. The average peeling strength was determined as the sheets of the test piece were peeled off from each other, (n=3). As for the peeling strength, an average load was determined from the load chart of tensile load curve at the peeled off point, and the result was expressed by a unit of kgf/25 mm. The symbol P in FIG. 5 designates the tensile load. The adhesive applied was a polyvinylchloride adhesive for hemming.

Tables 7 through 11 show the results of the analysis and the characteristics evaluation tests.

TABLE 7

| | | Fe—Ni—Zn film | | | | | | |
|---|---|---|---|---|---|---|---|---|
| Test | Coating type | Fe + Ni ($mg/m^2$) | Fe/ (Fe + Ni) | Zn/ (Fe + Ni) | Thickness of the oxide layer | Friction factor for press forming | Number of continuous welding spot | Peel strength |
| Comparative Example 1 | GA | 0 | — | — | — | 0.172 | 2800 | 6.1 |
| Comparative Example 2 | | 150 | 0.00 | 0.91 | 18.0 | 0.111 | 5900 | 4.0 |

TABLE 7-continued

| Test | Coating type | Fe—Ni—Zn film Fe + Ni ($mg/m^2$) | Fe/(Fe + Ni) | Zn/(Fe + Ni) | Thickness of the oxide layer | Friction factor for press forming | Number of continuous welding spot | Peel strength |
|---|---|---|---|---|---|---|---|---|
| Comparative Example 3 | | 160 | 0.08 | 0.82 | 19.0 | 0.110 | 6000 | 80 |
| Example 1 | | 140 | 0.15 | 0.75 | 19.0 | 0.111 | 6000 | 12.0 |
| Comparative 4 | | 6 | 0.50 | 0.26 | 0.8 | 0.130 | 5600 | 12.0 |
| Comparative 5 | | 150 | 0.39 | 0.13 | 0.7 | 0.125 | 6000 | 11.8 |
| Comparative 6 | | 240 | 0.30 | 0.06 | 1.0 | 0.126 | 6100 | 11.9 |
| Comparative 7 | | 360 | 0.20 | 0.03 | 0.9 | 0.125 | 6100 | 12.0 |
| Comparative 8 | | 620 | 0.18 | 0.02 | 1.0 | 0.127 | 6000 | 12.1 |
| Comparative 9 | | 7 | 0.48 | 15.0 | 20 | 0.165 | 3000 | 8.0 |
| Example 2 | | 140 | 0.41 | 0.90 | 20 | 0.110 | 6000 | 12.1 |
| Example 3 | | 230 | 0.33 | 0.40 | 22 | 0.109 | 6200 | 12.0 |
| Example 4 | | 360 | 0.20 | 0.20 | 23 | 0.110 | 5900 | 12.2 |
| Example 5 | | 600 | 0.18 | 0.15 | 25 | 0.111 | 6000 | 11.9 |
| Comparative 10 | | 480 | 0.16 | 0.12 | 23 | 0.165 | 2900 | 6.2 |

TABLE 8

| Test | Coating type | Fe—Ni—Zn film Fe + Ni ($mg/m^2$) | Fe/(Fe + Ni) | Zn/(Fe + Ni) | Thickness of the oxide layer | Friction factor for press forming | Number of continuous welding spot | Peel strength |
|---|---|---|---|---|---|---|---|---|
| Example 6 | GA | 220 | 0.70 | 0.4 | 20 | 0.110 | 6100 | 12.0 |
| Comparative 11 | | 190 | 0.92 | 0.4 | 22 | 0.110 | 3200 | 12.2 |
| Example 7 | | 200 | 0.22 | 1.4 | 19 | 0.109 | 5900 | 11.9 |
| Comparative 12 | | 140 | 0.24 | 2.1 | 20 | 0.135 | 4000 | 12.1 |

TABLE 9

| Test | Coating type | Fe—Ni—Zn film Fe + Ni ($mg/m^2$) | Fe/(Fe + Ni) | Zn/(Fe + Ni) | Thickness of the oxide layer (mm) | Friction factor for press forming | Number of continuous welding spot | Peel strength (Kgf/25 mm) |
|---|---|---|---|---|---|---|---|---|
| Comparative 13 | GA | 100 | 0.20 | 0.45 | 14.0 | 0.163 | 3000 | 6.5 |
| Example 8 | | 150 | 0.25 | 0.40 | 13.0 | 0.110 | 6100 | 12.0 |
| Comparative 14 | | 8 | 0.20 | 4.00 | 7.0 | 0.164 | 3200 | 8.2 |
| Example 9 | | 60 | 0.30 | 0.60 | 7.0 | 0.110 | 6000 | 12.2 |
| Comparative 15 | | 50 | 0.50 | 2.00 | 20.0 | 0.160 | 3200 | 6.3 |

TABLE 10

| Test | Coating type | Fe—Ni—Zn film Fe + Ni ($mg/m^2$) | Fe/(Fe + Ni) | Zn/(Fe + Ni) | Thickness of the oxide layer (mm) | Friction factor for press forming | Number of continuous welding spot | Peel strength (Kgf/25 mm) |
|---|---|---|---|---|---|---|---|---|
| Example 10 | GA | 100 | 0.40 | 0.40 | 21.0 | 0.110 | 6000 | 12.0 |
| Comparative 16 | | 180 | 0.15 | 0.25 | 1.2 | 0.125 | 6000 | 12.0 |
| Comparative 17 | | 170 | 0.14 | 0.23 | 1.3 | 0.127 | 5800 | 12.1 |
| Comparative 18 | | 190 | 0.13 | 0.23 | 2.5 | 0.125 | 5900 | 12.1 |
| Example 11 | | 180 | 0.14 | 0.25 | 4.0 | 0.110 | 6000 | 12.0 |
| Example 12 | | 180 | 0.13 | 0.40 | 22.0 | 0.109 | 6000 | 11.9 |
| Comparative 19 | | 170 | 0.15 | 0.26 | 2.9 | 0.126 | 6000 | 12.2 |
| Example 13 | | 160 | 0.16 | 0.27 | 5.0 | 0.110 | 5800 | 12.0 |
| Example 14 | | 190 | 0.15 | 0.45 | 22.0 | 0.109 | 6000 | 11.8 |
| Comparative 20 | | 180 | 0.15 | 0.25 | 2.8 | 0.127 | 6000 | 11.8 |
| Example 15 | | 200 | 0.16 | 0.25 | 5.0 | 0.110 | 6200 | 12.0 |
| Example 16 | | 180 | 0.13 | 0.40 | 23.0 | 0.109 | 6200 | 12.1 |
| Comparative 21 | | 180 | 0.14 | 0.24 | 1.1 | 0.125 | 6000 | 12.2 |
| Comparative 22 | | 190 | 0.16 | 0.27 | 1.2 | 0.128 | 5800 | 12.2 |
| Comparative 23 | | 170 | 0.17 | 0.30 | 7.0 | 0.126 | 6000 | 12.0 |
| Example 17 | | 180 | 0.15 | 0.30 | 6.0 | 0.110 | 5800 | 11.8 |

TABLE 10-continued

| Test | Coating type | Fe—Ni—Zn film Fe + Ni ($mg/m^2$) | Fe/(Fe + Ni) | Zn/(Fe + Ni) | Thickness of the oxide layer (mm) | Friction factor for press forming | Number of continuous welding spot | Peel strength (Kgf/25 mm) |
|---|---|---|---|---|---|---|---|---|
| Example 18 | | 180 | 0.15 | 0.40 | 20.0 | 0.109 | 5900 | 12.0 |
| Example 19 | | 180 | 0.14 | 0.50 | 26.0 | 0.111 | 6100 | 12.2 |
| Comparative 24 | | 180 | 0.14 | 0.30 | 8.0 | 0.125 | 5900 | 12.0 |
| Example 20 | | 170 | 0.13 | 0.30 | 8.0 | 0.110 | 6100 | 12.0 |
| Example 21 | | 180 | 0.15 | 0.35 | 18.0 | 0.110 | 6100 | 11.9 |

TABLE 11

| Test | Coating type | Fe—Ni—Zn film Fe + Ni ($mg/m^2$) | Fe/(Fe + Ni) | Zn/(Fe + Ni) | Thickness of the oxide layer (mm) | Friction factor for press forming | Number of continuous welding spot | Peel strength (Kgf/25 mm) |
|---|---|---|---|---|---|---|---|---|
| Comparative 25 | GI | — | — | — | — | 0.210 | 900 | 4.0 |
| Comparative 26 | | 220 | 0.15 | 0.14 | 0.9 | 0.130 | 4100 | 12.0 |
| Example 22 | | 210 | 0.14 | 0.14 | 6.0 | 0.110 | 4200 | 12.0 |
| Example 23 | | 220 | 0.16 | 0.40 | 15.0 | 0.110 | 4000 | 12.1 |
| Comparative 27 | EG | — | — | — | — | 0.152 | 1900 | 5.8 |
| Comparative 28 | | 220 | 0.15 | 0.14 | 0.8 | 0.127 | 4100 | 12.2 |
| Example 24 | | 230 | 0.16 | 0.30 | 12.0 | 0.109 | 4200 | 12.0 |
| Example 25 | | 220 | 0.15 | 0.50 | 25.0 | 0.111 | 4000 | 12.1 |

The following was revealed from the forming conditions of Fe—Ni—Zn film, which are shown in Tables 2 through 6, and from the test results shown in Tables 7 through 11.

(1) In the case that no Fe—Ni—Zn film is formed, (Comparative Examples 1, 25, and 27), all the coatings of GA, GI, and EG, on the zinciferous coated steel sheet are inferior in press-formability, spot-weldability, and adhesiveness to those in the case that an Fe—Ni—Zn film within the specified range of the present invention is formed.

(2) In the case that the concentration of $Fe^{2+}$ ion in electrolyte is lower than the specified range of the present invention, (Comparative Examples 2 and 3), the content of Fe/(Fe+Ni) in Fe—Ni—Zn film is small and the adhesiveness is inferior to that in the case that the above-described ion concentration is within the range of the present invention.

(3) In the case that the concentration of $Fe^{2+}$ ion in electrolyte is higher than the specified range of the present invention, (Comparative Examples 11), the content of Fe/(Fe+Ni) in Fe—Ni—Zn film is too large and it is not sufficient to improve the spot-weldability.

(4) In the case that the concentration of $Zn^{2+}$ ion in electrolyte is higher than the specified range of the present invention, (Comparative Examples 12), the content of Zn/(Fe+Ni) in Fe—Ni—Zn film is too large and it is not sufficient to improve the press-formability and the spot-weldability.

(5) In the case that an Fe—Ni—Zn film is formed by electrolytic treatment but no post-treatment is applied, (Comparative Examples 4 through 8, 26, and 28), the thickness of oxide layer in the surface layer part of Fe—Ni—Zn film is as thin as 1.0 nanometer or less, and that the press-formability is somewhat inferior to the case that both the electrolytic treatment and the post-treatment are applied within the specified range of the present invention.

(6) In the case that the current density of electrolysis is less than the specified range of the present invention, (Comparative Example 9), the content of (Fe+Ni) in Fe—Ni—Zn film is small and the press-formability, the spot-weldability, and the adhesiveness are inferior to those in the case that the current density is within the specified range of the present invention. On the other hand, if the current density of electrolysis is larger than the specified range of the present invention, (Comparative Example 10), burn of coating occurs, and the adhesiveness of the Fe—Ni—Zn film degrades, thus the press-formability, the spot-weldability, and the adhesiveness are inferior to the case that the current density is in the specified range of the present invention.

(7) In the case that the concentration of ($Fe^{2+}$, $Ni^{2+}$, and $Zn^{2+}$ ions) in electrolyte is less than the specified range of the present invention, (Comparative Example 13), burn of coating occurs, and the adhesiveness of the Fe—Ni—Zn film degrades, thus the press-formability, the spot-weldability, and the adhesiveness are inferior to those in the case that the ion concentration described above is in the specified range of the present invention.

(8) In the case that the pH value in electrolyte is less than the specified range of the present invention, (Comparative Example 15), the content of (Fe+Ni) in Fe—Ni—Zn film is small, thus the press-formability, the spot-weldability, and the adhesiveness are inferior to those in the case that the pH value is in the specified range of the present invention.

(9) In the case that the temperature of electrolyte is lower than the specified range of the present invention, (Comparative Example 15), burn of coating occurs, and the adhesiveness of the Fe—Ni—Zn film degrades, thus the press-formability, the spot-weldability, and the adhesiveness are inferior to those in the case that the temperature described above is in the specified range of the present invention.

(10) In the case that the pH value in the post-treatment liquid is less than the specified range of the present invention, (Comparative Examples 16 and 17), the thickness of oxide layer in the surface layer part of Fe—Ni—Zn film is small and the press-formability is somewhat inferior to that in the case that the pH value described above is within the specified range of the present invention. On the other hand, if the pH value in the post-treatment liquid is higher than the specified range of the present invention, (Comparative Examples 21 and 22), the thickness of oxide layer in the surface layer part of Fe—Ni—Zn film also small, and the press-formability is somewhat inferior to that in the case that the pH value is in the specified range of the present invention, (Examples 15 and 16).

(11) In the case that the period of post-treatment is shorter than the specified range of the present invention, Comparative Examples 18, 19, 20, 22, and 23), the thickness of oxide layer in the surface layer part of Fe—Ni—Zn film is thin, and that the press-formability is somewhat inferior to that in the case that the period described above is within the specified range of the present invention.

(12) All the Examples 1 through 25 which were processed under an electrolysis treatment condition and a post-treatment condition within the specified range of the present invention have the content of (Fe+Ni) in the formed Fe—Ni—Zn film, the content ratio of Fe/(Fe+Ni) therein, the content ratio of Zn/(Fe+Ni) therein, and the thickness of oxide layer in the surface layer part within an adequate range for improving the press-formability, the spot-weldability, and the adhesiveness, induce no burn of coating, and allow efficient manufacture of the product coated steel sheets. In addition, all the zinciferous coated steel sheets on which the above-described Fe—Ni—Zn film was formed show significant improvement in press-formability while showing excellent spot-weldability and adhesiveness.

Embodiment 3

The inventors of the present invention found that the formation of an adequate Fe—Ni—Zn film on the surface of the coating layer on a zinciferous coated steel sheet significantly improves the press-formability, spot-weldability, and adhesiveness.

Regarding the "adequate Fe—Ni—Zn film", the inventors has identified that the film satisfies the following-listed requirements (1) through (5).

(1) Deeper layer part of the film is a metallic layer of Fe, Ni, and Zn; Surface layer part of the film comprises of an oxide and a hydroxide of Fe, Ni, and Zn, (hereinafter the surface layer part is referred to as "the oxide layer").

(2) Sum of Fe content and Ni content in the film is in a range of from 10 to 1500 $mg/m^2$.

(3) Ratio of Fe content ($mg/m^2$) to the sum of Fe content and Ni content ($mg/m^2$) in the film, or Fe/(Fe+Ni), is in a range of from 0.1 to 0.8.

(4) Ratio of Zn content ($mg/m^2$) to the sum of Fe content and Ni content ($mg/m^2$) in the film, or Zn/(Fe+Ni), is 1.6 or less, while excluding the case of Zn/(Fe+Ni)=0 because the film contains Zn.

(5) Thickness of the oxide layer in the film surface layer part is in a range of from 4 to 50 nanometer.

The cause of inferiority of press-formability of zinciferous coated steel sheet compared with that of cold-rolled steel sheet is the increase in sliding resistance resulted from adhesion phenomenon between the mold and the zinc having a low melting point under high pressure condition. The inventors considered that it is effective to form a film having higher hardness than zinc or zinc alloy coating layer and having higher melting point than thereof on the surface of coating layer of zinciferous coated steel sheet. Based on the consideration, the inventors have derived a finding that the formation of an adequate Fe—Ni—Zn film on the surface of zinciferous coated steel sheet decreases the sliding resistance between the surface of coating layer and the press mold during press-forming operation, thus improves the press-formability. The reason of the reduction of sliding resistance is presumably that the Fe—Ni—Z film is hard and that the oxide layer existing in the surface layer part of the film has high melting point so that the film hardly generates adhesion with the mold during press-forming operation.

The reason of inferiority of zinciferous coated steel sheet in continuous spot weldability compared with that of cold-rolled steel sheet is the formation of a brittle alloy layer caused by the contact between the molten zinc with the copper of electrode during welding operation, which enhances degradation of electrode. To improve the spot-weldability, the inventors investigated various kinds of films, and found that a metallic layer consisting of Fe, Ni, and Zn is particularly effective. The reason of the effectiveness is not fully analyzed, but the presumable reason is high melting point of the metallic film consisting of Fe, Ni, and Zn, and also is high electric conductivity. Since the Fe—Ni—Zn layer according to the present invention has the lower layer part made of a metallic layer consisting of Fe, Ni, and Zn, the superior continuous spot weldability is attained. The Fe—Ni—Zn film according to the present invention has an oxide layer having low electric conductivity in the surface layer thereof, and the bad influence to the continuous spot weldability is avoided by controlling the thickness of the oxide layer.

It is known that the adhesiveness of zinciferous coated steel sheets is inferior to that of cold-rolled steel sheets. The cause was, however, not known. To this point, the inventors have found that excellent adhesiveness is attained by forming an Fe—Ni—Zn film in which the Fe content is adequately controlled onto the surface of zinciferous coated steel sheet.

The present invention has been derived based on the above-described findings, and the present invention provides a method to manufacture zinciferous coated steel sheets having excellent press-formability, spot-weldability, and adhesiveness by forming an Fe—Ni—Zn film on the surface of the zinciferous coated steel sheet. The aspects of the present invention are described below.

The first aspect of the present invention is to provide a method for manufacturing zinciferous coated steel sheet comprising the steps of: using an electrolyte consisting of acidic sulfate aqueous solution containing $Fe^{2+}$, $Ni^{2+}$, and $Zn^{2+}$ ions, while containing 0.3 to 2.0 mol/liter of total concentration of $Fe^{2+}$ and $Ni^{2+}$ ions, 0.02 to 1.0 mol/liter of $Fe^{2+}$ ion, more than 0 mol/liter and not more than 0.5 mol/liter of $Zn^{2+}$ ion, giving 1 to 3 of pH, and giving a temperature range of from 30 to 70° C.; carrying out electrolysis therein using a zinciferous coated steel sheet as a cathode under a current density ranging from 10 to 150 $A/dm^2$; then washing thus electrolyzed steel sheet with water having a temperature ranging from 60 to 100° C.

The second aspect of the present invention is to provide a method for manufacturing zinciferous coated steel sheet comprising the steps of: using an electrolyte consisting of acidic sulfate aqueous solution containing $Fe^{2+}$, $Ni^{2+}$, and $Zn^{2+}$ ions, while containing 0.3 to 2.0 mol/liter of total concentration of $Fe^{2+}$ and $Ni^{2+}$ ions, 0.02 to 1.0 mol/liter of $Fe^{2+}$ ion, more than 0 mol/liter and not more than 0.5 mol/liter of $Zn^{2+}$ ion, giving 1 to 3 of pH, and giving a temperature range of from 30 to 70° C.; carrying out electrolysis therein using a zinciferous coated steel sheet as a cathode under a current density ranging from 10 to 150 $A/dm^2$; then blowing steam against thus electrolyzed steel sheet.

The following is the reason for specifying the values of variables for manufacturing condition according to the present invention.

When the electrolyte contains less than 0.3 mol/liter of total concentration of $Fe^{2+}$ and $Ni^{2+}$ ions, burn of coating occurs to decrease the adhesiveness of Fe—Ni—Zn film, thus failing to obtain the effect of improvement in press-formability, spot-weldability, and adhesiveness. On the other hand, when the total concentration above-described exceeds 2.0 mol/liter, the solubility reaches the upper limit thereof, and, if temperature is low, precipitate of ferrous sulfate and zinc sulfate appears. Accordingly, the total concentration of $Fe^{2+}$ and $Ni^{2+}$ ions should be limited in a range of from 0.3 to 2.0 mol/liter.

Excellent adhesiveness is attained by forming an Fe—Ni—Zn film in which the Fe content is adequately controlled onto the surface of zinciferous coated steel sheet. When the $Fe^{2+}$ ion concentration is lower than 0.02 mol/liter, the ratio of Fe content ($mg/m^2$) to the sum of Fe content and Ni content ($mg/m^2$) in the film, or Fe/(Fe+Ni), is difficult to reach 0.1 or higher level, which results in insufficient effect of improvement of adhesiveness. When the $Fe^{2+}$ ion concentration in the electrolyte exceeds 1.0 mol/liter, the ratio of Fe content ($mg/m^2$) to the sum of Fe content and Ni content ($mg/m^2$) in the film, or Fe/(Fe+Ni), cannot be brought to 0.8 or lower level, which results in insufficient effect of improvement of spot-weldability. Consequently, the $Fe^{2+}$ ion concentration in the electrolyte should be limited in a range of from 0.02 to 1.0 mol/liter.

When the concentration of $Fe^{2+}$ ion in the electrolyte increases, the rate of formation of $Fe^{+3}$ ion increases owing to the oxidation by air or by anode. The $Fe^{3+}$ ion is readily converted to sludge of iron hydroxide. Therefore, in a bath with a high content of $Fe^{2+}$ ion, large amount of sludge generates to adhere to the surface of zinciferous coated steel sheet, which then likely induces surface defects such as dents. In this respect, the concentration of $Fe^{2+}$ ion is preferably limited to 0.6 mol/liter or less.

Since an object of the present invention is to form an adequately controlled Fe—Ni—Zn film, the electrolyte has to contain $Zn^{2+}$ ion. When $Zn^{2+}$ ion concentration in the electrolyte exceeds 0.5 mol/liter, the effect of improvement of press-formability and spot-weldability become insufficient. Therefore, the concentration of $Zn^{2+}$ in the electrolyte should be limited in a range of from more than zero to not more than 0.5 mol/liter.

The electrolyte may further contain a pH buffer to improve the adhesiveness thereof. Examples of the pH buffer are boric acid, citric acid, acetic acid, oxalic acid, malonic acid, tartaric acid, salts thereof, and ammonium sulfate.

The electrolyte may further contain unavoidable cations such as those of Co, Mn, Mo, Al, Ti, Sn, W, Si, Pb, Nb, and Ta, hydroxides and oxides, and anions other than sulfate ion, which ions are included in the coating layer of zinciferous coated steel sheet used in the present invention.

When the pH value of electrolyte is less than 1, hydrogen generation becomes the main part of the cathode reaction, thus the current efficiency is significantly reduced. On the other hand, when the pH value exceeds 3, ferric hydroxide precipitates. Consequently, the pH value of electrolyte should be controlled within a range of from 1 to 3.

When the temperature of electrolyte is less than 30° C., burn of coating occurs to degrade the adhesiveness of Fe—Ni—Zn film, which fails to attain the effect of improvement of press-formability, spot-weldability, and adhesiveness. On the other hand, the temperature of electrolyte exceeds 70° C., evaporation of the electrolyte is enhanced, which makes the control of concentration of $Fe^{2+}$, $Ni^{2+}$, and $Zn^{2+}$ ions difficult. Therefore, the temperature of electrolyte should be limited in a range of from 30 to 70° C.

Regarding the current density for electrolysis, below 10 $A/dm^2$ of current density makes the hydrogen generation govern the anodic reaction, thus significantly reducing the current efficiency. On the other hand, if the current density exceeds 150 $A/dm^2$, burn of coating occurs to degrade the adhesiveness of Fe—Ni—Zn film, thus failing in attaining the effect of improvement of press-formability, spot-weldability, and adhesiveness. Accordingly, the current density of electrolysis should be limited in a range of from 10 to 150 $A/dm^2$.

The effect of improvement of formability is drastically enhanced by selecting the thickness of oxide layer in the surface layer part of Fe—Ni—Zn film to 4 nm or more. On the other hand, since the oxide layer has high electric resistance, the spot-weldability degrades if the thickness thereof exceeds 50 nm. Consequently, the thickness of oxide layer in the surface layer part of Fe—Ni—Zn film should be limited in a range of from 4 to 50 nm. Nevertheless, the thickness of oxide layer in the surface layer part of Fe—Ni—Zn film obtained by the electrolysis described above is less than 4 nm.

To this point, the inventors conducted studies for developing post-treatment technology to attain 4 nm or thicker oxide layer in the surface layer part of Fe—Ni—Zn film, and found that the thickness of oxide layer in the surface layer part of Fe—Ni—Zn film is brought to 4 nm or more and that the effect of improvement of formability is drastically improved by applying washing the zinciferous coated steel sheet in a state that electrolyte residue still remains on the surface thereof using hot water having a temperature of 60 to 100° C., or by applying blowing of steam against the surface of the zinciferous coated steel sheet in a state that electrolyte residue still remains on the surface thereof.

The mechanism of thickening the oxide layer in the surface layer part of Fe—Ni—Zn film by washing thereof with hot water is presumably the following-described one. When a zinciferous coated steel sheet in a state that electrolyte residue still remains on the surface thereof is washed with hot water, the surface presumably becomes a state that weak acidic liquid film exists thereon. Then, on the surface of the zinciferous coated steel sheet, Zn and Fe dissolving reactions (4) and (5), respectively, and hydrogen generation reaction (6) simultaneously occur in the Fe—Ni—Zn layer and in the coating layer.

$$Zn \rightarrow Zn^{2+} + 2e \quad (4)$$

$$Fe \rightarrow Fe^{2+} + 2e \quad (5)$$

$$H^{+} + e \rightarrow (1/2)H_2 \quad (6)$$

Since the reaction (6) consumes $H^+$ ion, the pH value increases in the vicinity of surface of the Fe—Ni—Zn film. As a result, once-dissolved $Zn^{2+}$ and $Fe^{2+}$ are caught by the Fe—Ni—Zn film in a form of hydroxide, which results in the increased thickness of the oxide layer.

In the step succeeding to electrolysis, when the temperature of washing water is less than 60° C., the effect of increased thickness of the oxide layer is not sufficient presumably because of the lowering of rate of the reactions (4) through (6) described above. Accordingly, the temperature of the water for washing should be limited in a range of from 60 to 100° C.

The flow rate of washing water is not specifically limited. Nevertheless, the flow rate is preferably select to 100 cc/$m^2$-steel sheet or more to effectively increase the thickness of oxide layer by increasing the temperature of the surface of steel sheet.

When the water washing is performed in two or more steps, if the water washing in the succeeding step to the electrolysis is carried out using hot water having a temperature ranging from 60 to 100° C., then the thickness of the oxide layer can be increased to 4 nm or more within the step, so that the water washing in following step may be conducted by water at a temperature of less than 60° C. If, however, water washing step next to the electrolysis is carried out by water at a temperature of less than 60° C., the effect of increase in the thickness of oxide layer is not sufficient even when the following water washing step is performed by water having a temperature ranging from 60 to 100° C. The reason for failing to attain satisfactory effect is presumably that the first water washing removes the residue of electrolyte from the surface of zinciferous coated steel sheet, thus failing to establish a state that a weak acidic liquid film exists on the surface thereof in the following water washing step using water at a temperature ranging from 60 to 100° C.

As described above, the water washing using hot water is necessarily carried out in a state that a residue of electrolyte exists on the surface of zinciferous coated steel sheet. To this point, however, the amount of remained residue on the surface of zinciferous coated steel sheet may be controlled by roll-squeezing or the like before applying water washing.

The mechanism to increase the thickness of oxide layer in the surface layer part of Fe—Ni—Zn film by blowing steam against the surface thereof is speculated as follows. When steam is blown against the surface of zinciferous coated steel sheet in a state that a residue of electrolyte having a pH value of 1 to 3 exists, the steam condenses on the surface thereof, and a weak acidic liquid film which is formed by diluting the electrolyte residue with the condensate should exists on the surface thereof. Then, on the surface of zinciferous coated steel sheet, the above-described Zn and Fe dissolving reactions (4) and (5), and hydrogen generation reaction (6) simultaneously occur in the Fe—Ni—Zn layer and in the coating layer, as in the case of washing with hot water. Since the reaction (6) consumes $H^+$ ion, the pH value increases in the vicinity of surface of the Fe—Ni—Zn film. As a result, once-dissolved $Zn^{2+}$ and $Fe^{2+}$ are caught by the Fe—Ni—Zn film in a form of hydroxide, which results in the increased thickness of the oxide layer. The rate of these reactions is high because the temperature of the surface of steel sheet is increased by the blown steam, so the thickness of oxide layer can be effectively increased.

The temperature and the flow rate of steam are not specifically limited. To effectively increase the thickness of oxide by increasing the surface temperature of the steel sheet, however, the temperature is preferably set to 110° C. or more, and the flow rate is preferably set to 5 g/$m^2$-steel sheet or more.

The water washing step aiming at the removal of electrolyte is necessary to conduct after the steam blow treatment. If the water washing step is applied before the steam blow treatment, the effect of increase in the thickness of oxide layer by the steam blow treatment is not sufficient. A presumable reason is that the electrolyte residue on the surface of zinciferous coated steel sheet is washed out by water washing, thus failing to establish a state that weak acidic film exists on the surface thereof in the steam blow treatment.

As described above, the steam blow is required to be conducted in a state that the residue of electrolyte exists on the surface of zinciferous coated steel sheet. The amount of remained residue on the surface of zinciferous coated steel sheet may be controlled by roll-squeezing or the like before applying water washing.

The zinciferous coated steel sheet according to the present invention to use for forming an Fe—Ni—Zn film on the surface thereof may be a steel sheet that forms a zinc or zinc alloy coating layer on the surface thereof by hot-dip coating method, electroplating method, chemical vapor deposition method, or the like. The zinc or zinc alloy coating layer is made of a single phase coating layer or of multiple phase coating layer that contains pure Zn, and one or more of metals or their oxides or their organic compounds selected from the group of Fe, Ni, Co, Mn, Cr, Al, Mo, Ti, Si, W, Sn, Pb, Nb, and Ta, and the like, (wherein Si is dealt as a metal). The above-described coating layer may further contain fine particles of $SiO_2$, $Al_2O_3$, and the like. Furthermore, the zinciferous coated steel sheet may be a multiple-coating steel sheet or a functionally gradient coating steel sheet, which give varied composition in the coating layer, may be used.

EXAMPLE

Example 1

As for the zinciferous coated steel sheets before forming the film by electrolysis used in the method according to the present invention and the comparative methods, either of GA, GI, and EG, specified below was applied.

GA: Alloyed zinc hot dip coated steel sheet (10 wt. % Fe, balance of Zn), with 60 g/$m^2$ of coating weight on each side.

GI: Zinc hot dip coating steel sheet, with 90 g/$m^2$ of coating weight on each side.

EG: Zinc electroplated steel sheet, with 40 g/$m^2$ of coating weight on each side.

To each of the above-described three kinds of zinciferous coated steel sheets, anodic electrolysis was carried out in an electrolyte of an acidic sulfate aqueous solution containing $Fe^{2+}$, $Ni^{2+}$, and $Zn^{2+}$ ions. Boric acid was added as pH buffer to the electrolyte. The electrolysis was carried out under a condition of varied variables of: concentration of $Fe^{2+}$, $Ni^{2+}$, and $Zn^{2+}$ in the electrolyte; pH value and temperature of the electrolyte; and current density, etc. Following the electrolysis, water washing treatment was carried out at various levels of temperature and flow rate. In this manner, Fe—Ni—Zn film was formed on the surface of each zinciferous coated steel sheet.

Detailed conditions to form Fe—Ni—Zn film are listed in Tables 1 for Examples 1 through 18 which correspond to the methods within the range of the present invention, and for Comparative Examples 1 through 17 which correspond to the methods outside of the range of the present invention at least one requirement thereof. Examples 9 and 13, and Comparative Examples 9 and 13 are the cases that water washing was carried out in two separate steps, wherein left side figure of arrow mark designates the condition of first water washing, and right side thereof designates the condition of second water washing.

TABLE 12

| | Conditions of electrolysis | | | | | | | Conditions of water washing | | |
|---|---|---|---|---|---|---|---|---|---|---|
| | Electrolyte | | | | | | | | | |
| Coating type | Composition | Concentration of sum of $Fe^{2+}$ and $Ni^{2+}$ (mol/l) | pH | Temperature (° C.) | Liquid flow speed | Current density (A/dm$^2$) | Coating time (sec) | Temperature (° C.) | Flow rate (l/m$^2$) | Test No. |
| GA | — | — | — | — | — | — | — | — | — | Comparative 1 |
| | Nickel sulfate 1.8 mol/l<br>Ferrous sulfate 0.00 mol/l<br>Zinc sulfate 0.05 mol/l<br>Boric acid 30 g/l | 1.8 | 2.0 | 50 | 2.0 | 10 | 2 | 80 | 2 | Comparative 2 |
| | Nickel sulfate 1.8 mol/l<br>Ferrous sulfate 0.01 mol/l<br>Zinc sulfate 0.05 mol/l<br>Boric acid 30 g/l | 1.81 | 2.0 | 50 | 2.0 | 10 | 2 | 80 | 2 | Comparative 3 |
| | Nickel sulfate 1.8 mol/l<br>Ferrous sulfate 0.02 mol/l<br>Zinc sulfate 0.05 mol/l<br>Boric acid 30 g/l | 1.82 | 2.0 | 50 | 2.0 | 10 | 2 | 80 | 2 | Invention 1 |
| | Nickel sulfate 1.8 mol/l<br>Ferrous sulfate 0.2 mol/l<br>Zinc sulfate 0.05 mol/l<br>Boric acid 30 g/l | 2 | 2.0 | 50 | 2.0 | 7 | 2 | 80 | 4 | Comparative 4 |
| | | | | | | 10 | 2 | | | Invention 2 |
| | | | | | | 50 | 0.5 | | | Invention 3 |
| | | | | | | 100 | 0.2 | | | Invention 4 |
| | | | | | | 140 | 0.2 | | | Invention 5 |
| | | | | | | 170 | 0.2 | | | Comparative 5 |
| | Nickel sulfate 0.15 mol/l<br>Ferrous sulfate 0.03 mol/l<br>Zinc sulfate 0.02 mol/l<br>Boric acid 30 g/l | 0.18 | 2.8 | 60 | 2.0 | 50 | 0.5 | 80 | 2 | Comparative 6 |
| | Nickel sulfate 0.3 mol/l<br>Ferrous sulfate 0.06 mol/l<br>Zinc sulfate 0.04 mol/l<br>Boric acid 30 g/l | 0.36 | 2.8 | 60 | 2.0 | 50 | 0.5 | 80 | 2 | Invention 6 |
| | Nickel sulfate 1.0 mol/l<br>Ferrous sulfate 1.0 mol/l<br>Zinc sulfate 0.2 mol/l<br>Boric acid 30 g/l | 2.0 | 1.8 | 50 | 1.0 | 70 | 0.2 | 80 | 2 | Invention 7 |
| | Nickel sulfate 0.5 mol/l<br>Ferrous sulfate 1.5 mol/l<br>Zinc sulfate 0.2 mol/l<br>Boric acid 30 g/l | 2.0 | 1.8 | 50 | 1.0 | 70 | 0.2 | 80 | 2 | Comparative 7 |
| | Nickel sulfate 1.3 mol/l<br>Ferrous sulfate 0.2 mol/l<br>Zinc sulfate 0.5 mol/l<br>Boric acid 30 g/l | 1.5 | 2.0 | 60 | 2.0 | 90 | 0.2 | 80 | 2 | Invention 8 |
| | Nickel sulfate 1.3 mol/l<br>Ferrous sulfate 0.2 mol/l<br>Zinc sulfate 1.0 mol/l<br>Boric acid 30 g/l | 1.5 | 2.0 | 60 | 2.0 | 90 | 0.2 | 80 | 2 | Comparative 8 |
| | Nickel sulfate 1.3 mol/l<br>Ferrous sulfate 0.2 mol/l<br>Zinc sulfate 0.3 mol/l<br>Boric acid 30 g/l | 1.5 | 0.8 | 45 | 1.5 | 50 | 2 | 80→25 | 0.3→2 | Comparative 9 |
| | | | 1.2 | 45 | 1.5 | 50 | 2 | 80→25 | 0.3→2 | Invention 9 |
| | Nickel sulfate 0.6 mol/l<br>Ferrous sulfate 0.1 mol/l<br>Zinc sulfate 0.1 mol/l<br>Boric acid 30 g/l | 0.7 | 2.2 | 25 | 2.5 | 50 | 0.5 | 80 | 1 | Comparative 10 |
| | | | | 35 | 2.5 | 50 | 0.5 | 80 | 1 | Invention 10 |
| | Nickel sulfate 1.1 mol/l<br>Ferrous sulfate 0.1 mol/l<br>Zinc sulfate 0.3 mol/l<br>Boric acid 30 g/l | 1.2 | 2.0 | 50 | 2.0 | 50 | 0.5 | 25 | 1 | Comparative 11 |
| | | | | | | | | 40 | 1 | Comparative 12 |
| | | | | | | | | 40→100 | 1→1 | Comparative 13 |
| | | | | | | | | 60 | 1 | Invention 11 |
| | | | | | | | | 80 | 1 | Invention 12 |
| | | | | | | | | 80→25 | 1→1 | Invention 13 |
| | | | | | | | | 100 | 1 | Invention 14 |
| GI | — | — | — | — | — | — | — | — | — | Comparative 14 |
| | Nickel sulfate 1.0 mol/l<br>Ferrous sulfate 0.1 mol/l<br>Zinc sulfate 0.1 mol/l<br>Boric acid 30 g/l | 1.1 | 2.0 | 50 | 2.0 | 50 | 0.5 | 40 | 2 | Comparative 15 |
| | | | | | | | | 60 | 2 | Invention 15 |
| | | | | | | | | 80 | 2 | Invention 16 |
| EG | — | — | — | — | — | — | — | — | — | Comparative 16 |
| | Nickel sulfate 1.0 mol/l<br>Ferrous sulfate 0.1 mol/l<br>Zinc sulfate 0.1 mol/l<br>Boric acid 30 g/l | 1.1 | 2.0 | 50 | 2.0 | 50 | 0.5 | 40 | 2 | Comparative 17 |
| | | | | | | | | 60 | 2 | Invention 17 |
| | | | | | | | | 80 | 2 | Invention 18 |

Under the conditions given above, specimens were prepared from individual zinciferous coated steel sheets with Fe—Ni—Zn film formed thereon. Specimens were also prepared from the steel sheet which was not subjected to forming the Fe—Ni—Zn film on the surface thereof. Thus prepared specimens underwent the analysis of Fe—Ni—Zn film and the characteristics evaluation tests in terms of press-formability, spot-weldability, and adhesiveness for the zinciferous coated steel sheets. The applied analytical method and characteristics evaluation test method are described in the following.

(1) Analytical Method

"Sum of Fe content and Ni content ($mg/m^2$) in the film, Ratio of Fe/(Fe+Ni) ($mg/m^2$) in the film, and Ratio of Zn/(Fe+Ni) ($mg/m^2$) in the film"

Since the lower layer, or the coating layer, contains Fe and Zn among the ingredients of Fe—Ni—Zn film, ICP method is difficult to completely separate the elements in Fe—Ni—Zn film, or the upper layer, from the elements in the coating layer, or the lower layer. Accordingly, ICP method was applied to analyze quantitatively only Ni element which does not exist in the lower layer, or the coating layer. After applying Ar ion-sputtering, XPS method was applied to repeat the determination of individual elements in Fe—Ni—Zn film from the surface thereof, thus determining the composition distribution of individual elements in the depth direction vertical to the surface of Fe—Ni—Zn film. According to the method, the thickness of Fe—Ni—Zn film was defined by an average depth of the depth giving the maximum concentration of Ni element in the Fe—Ni—Zn film, which Ni element does not exist in the lower layer, or the coating layer, and the depth at which Ni element disappears. The coating weight and the composition of Fe—Ni—Zn film were computed from the results of the ICP method and the XPS method. Then, a computation was carried out to derive the sum of Fe content and Ni content ($mg/m^2$) in the film, the ratio of Fe/(Fe+Ni) ($mg/m^2$) in the film, and the ratio of Zn/(Fe+Ni) ($mg/m^2$) in the film.

"Thickness of Oxide Layer in the Surface Layer Part of Film"

The thickness of oxide layer in the surface layer part of Fe—Ni—Zn film was determined by a combination of Ar ion sputtering method with X-ray Photoelectron Spectroscopic method (XPS) or Auger electron spectroscopy (AES). That is, Ar ion sputtering was applied to a specific depth from the surface of a specimen, then XPS or AES was applied to determine individual elements in the film, and the processing was repeated. According to the determination process, the amount of oxygen generated from oxide or hydroxide reaches a maximum level followed by reducing to approach to a constant level. The thickness of the oxide layer was selected as a depth giving half of the sum of the maximum concentration and the constant concentration level in a deeper portion than the maximum concentration point. The reference specimen used for determining the sputtering rate was $SiO_2$. The determined sputtering rate was 4.5 nanometer/min.

(2) Characteristics Evaluation Tests

"Friction Factor Determination Test"

To evaluate the press-formability, friction factor of each specimen was determined using a device described below.

FIG. 1 shows a schematic drawing of the friction tester giving the side view thereof.

The friction factor $\mu$ between the test piece and the bead was computed by the equation of $\mu$=F/N. The pressing force N was selected to 400 kgf, and the draw-off speed of the test piece (the horizontal moving speed of the slide table 3) was selected to 100 cm/min.

FIG. 2 shows a schematic perspective view of the bead illustrating the shape and dimensions thereof.

[Continuous Spot Weldability Test]

To evaluate the spot-weldability, continuous spot weldability test was given to each specimen. Two sheets of specimens having the same dimensions to each other were laminated together. A pair of electrode chips sandwiched the laminated specimens from top and bottom sides. Then electric power was applied to the specimens under a pressing force to focus the current on a spot to conduct continuous resistance welding (spot welding) under the condition given below.

Electrode chip: Dome shape having 6 mm of tip diameter

Pressing force: 250 kgf

Welding time: 0.2 second

Welding current: 11.0 kA

Welding speed: 1 point/sec

The evaluation of continuous spot weldability was given by the number of continuous welding spots until the diameter of melted-solidified metallic part (nugget) generated at the joint of overlaid two welding base sheets (specimens) becomes less than $4\times t^{1/2}$ (t is the thickness of a single plate, mm). The number of continuous welding spots is referred to hereinafter as the electrode life.

[Adhesiveness Test]

From each specimen, the following-described test piece for adhesiveness test was prepared.

FIG. 4 shows a schematic perspective view illustrating the assembling process of the test piece. Thus prepared test piece was bent in the T-shape as shown in FIG. 5. The bent ends of T-shaped test piece 13 were pulled to opposite directions to each other at a drawing speed of 200 mm/min. using a tensile tester. The average peeling strength was determined as the sheets of the test piece were peeled off from each other, (n=3). As for the peeling strength, an average load was determined from the load chart of tensile load curve at the peeled off point, and the result was expressed by a unit of kgf/25 mm. The symbol P in FIG. 5 designates the tensile load. The adhesive applied was a polyvinylchloride adhesive for hemming.

Table 13 shows the results of the analysis and the characteristics evaluation tests.

TABLE 13

| | | Fe—Ni—Zn film | | | | Press- | Spot- | Adhesion |
|---|---|---|---|---|---|---|---|---|
| Coating Type | Test No. | Fe + Ni ($mg/m^2$) | Fe/ (Fe + Ni) | Zn/ (Fe + Ni) | Thickness of oxide layer (nm) | formability Friction factor | weldability Number of continuous welding spots | performance Peel strength (kgf/25 mm) |
| GA | Comparative 1 | 0 | — | — | — | 0.172 | 2800 | 6.1 |
| | Comparative 2 | 150 | 0 | 0.49 | 11 | 0.111 | 5900 | 4.0 |

TABLE 13-continued

| Coating Type | Test No. | Fe—Ni—Zn film: Fe + Ni ($mg/m^2$) | Fe/(Fe + Ni) | Zn/(Fe + Ni) | Thickness of oxide layer (nm) | Press-formability Friction factor | Spot-weldability Number of continuous welding spots | Adhesion performance Peel strength (kgf/25 mm) |
|---|---|---|---|---|---|---|---|---|
| | Comparative 3 | 160 | 0.08 | 0.51 | 12 | 0.110 | 6000 | 8.0 |
| | Invention 1 | 140 | 0.15 | 0.45 | 11 | 0.111 | 6000 | 12.0 |
| | Comparative 4 | 8 | 0.50 | 10 | 9 | 0.165 | 3000 | 8.0 |
| | Invention 2 | 140 | 0.41 | 0.60 | 12 | 0.110 | 6000 | 12.0 |
| | Invention 3 | 230 | 0.33 | 0.30 | 11 | 0.109 | 6200 | 12.0 |
| | Invention 4 | 360 | 0.20 | 0.16 | 11 | 0.110 | 5900 | 12.2 |
| | Invention 5 | 600 | 0.18 | 0.13 | 10 | 0.111 | 6500 | 11.9 |
| | Comparative 5 | 480 | 0.16 | 0.10 | 13 | 0.165 | 2900 | 6.2 |
| | Comparative 6 | 100 | 0.20 | 0.35 | 10 | 0.163 | 3000 | 6.5 |
| | Invention 6 | 150 | 0.25 | 0.35 | 11 | 0.110 | 6100 | 12.0 |
| | Invention 7 | 210 | 0.72 | 0.35 | 11 | 0.110 | 6000 | 11.9 |
| | Comparative 7 | 210 | 0.90 | 0.30 | 10 | 0.110 | 3200 | 11.9 |
| | Invention 8 | 200 | 0.22 | 1.20 | 10 | 0.112 | 6000 | 12.0 |
| | Comparative 8 | 120 | 0.23 | 1.80 | 11 | 0.130 | 4000 | 12.0 |
| | Comparative 9 | 8 | 0.20 | 6.00 | 9 | 0.164 | 3200 | 8.2 |
| | Invention 9 | 60 | 0.30 | 0.60 | 8 | 0.114 | 6000 | 12.2 |
| | Comparative 10 | 50 | 0.50 | 1.4 | 11 | 0.160 | 3200 | 6.3 |
| | Invention 10 | 100 | 0.40 | 0.40 | 9 | 0.110 | 6000 | 12.0 |
| | Comparative 11 | 170 | 0.14 | 0.23 | 1.2 | 0.126 | 6000 | 12.1 |
| | Comparative 12 | 180 | 0.15 | 0.25 | 1.9 | 0.125 | 6000 | 12.0 |
| | Comparative 13 | 180 | 0.15 | 0.26 | 2.1 | 0.126 | 5900 | 12.2 |
| | Invention 11 | 170 | 0.14 | 0.28 | 4.4 | 0.110 | 5800 | 12.1 |
| | Invention 12 | 190 | 0.13 | 0.33 | 11 | 0.109 | 5900 | 12.1 |
| | Invention 13 | 180 | 0.12 | 0.32 | 10 | 0.111 | 6000 | 11.9 |
| | Invention 14 | 180 | 0.14 | 0.38 | 17 | 0.107 | 6000 | 12.0 |
| GI | Comparative 14 | — | — | — | — | 0.210 | 900 | 4.0 |
| | Comparative 15 | 220 | 0.15 | 0.14 | 2.1 | 0.130 | 4100 | 12.0 |
| | Invention 15 | 210 | 0.14 | 0.22 | 4.5 | 0.110 | 4200 | 12.0 |
| | Invention 16 | 220 | 0.16 | 0.32 | 10 | 0.110 | 4000 | 12.1 |
| EG | Comparative 16 | — | — | — | — | 0.152 | 1900 | 5.8 |
| | Comparative 17 | 220 | 0.15 | 0.14 | 2.1 | 0.127 | 4100 | 12.2 |
| | Invention 17 | 230 | 0.16 | 0.21 | 4.7 | 0.109 | 4200 | 12.0 |
| | Invention 18 | 220 | 0.15 | 0.30 | 10 | 0.111 | 4000 | 12.1 |

The following was revealed from the forming conditions of Fe—Ni—Zn film, which are shown in Tables 12, and from the test results shown in Table 13.

(1) In the case that no Fe—Ni—Zn film is formed, (Comparative Examples 1, 14, and 16), all the coatings of GA, GI, and EG, on the zinciferous coated steel sheet are inferior in press-formability, spot-weldability, and adhesiveness to those in the case that an Fe—Ni—Zn film within the specified range of the present invention is formed.

(2) In the case that the concentration of $Fe^{2+}$ ion in electrolyte is lower than the specified range of the present invention, (Comparative Examples 2 and 3), the content of Fe/(Fe+Ni) in Fe—Ni—Zn film is small and the adhesiveness is inferior to that in the case that the above-described ion concentration is within the range of the present invention.

(3) In the case that the current density of electrolysis is less than the specified range of the present invention, (Comparative Example 4), the content of (Fe+Ni) in Fe—Ni—Zn film is small because of poor current efficiency, and the press-formability, the spot-weldability, and the adhesiveness are inferior to those in the case that the current density is within the specified range of the present invention. On the other hand, if the current density of electrolysis is larger than the specified range of the present invention, (Comparative Example 5), bum of coating occurs, and the adhesiveness of the Fe—Ni—Zn film degrades, thus the press-formability, the spot-weldability, and the adhesiveness are inferior to the case that the current density is in the specified range of the present invention.

(4) In the case that the concentration of ($Fe^{2+}$+$Ni^{2+}$ ions) in electrolyte is less than the specified range of the present invention, (Comparative Example 6), burn of coating occurs, and the adhesiveness of the Fe—Ni—Zn film degrades, thus the press-formability, the spot-weldability, and the adhesiveness are inferior to those in the case that the ion concentration described above is in the specified range of the present invention.

(5) In the case that the concentration of $Fe^{2+}$ ion in electrolyte is higher than the specified range of the present invention, (Comparative Example 7), the content of Fe/(Fe+Ni) in Fe—Ni—Zn film is large and the spot-weldability is inferior to that in the case that $Fe^{2+}$ ion concentration is within the range of the present invention.

(6) In the case that the concentration of $Zn^{2+}$ ion in electrolyte is higher than the specified range of the present invention, (Comparative Example 8), the content of Zn/(Fe+Zn) in Fe—Ni—Zn film is large and the spot-weldability is inferior to that in the case that $Zn^{2+}$ ion concentration is within the range of the present invention.

(7) In the case that the pH value in electrolyte is less than the specified range of the present invention, (Comparative Example 9), the content of (Fe+Ni) in Fe—Ni—Zn film is small because of poor current efficiency, thus the press-formability, the spot-weldabillity, and the adhesiveness are inferior to those in the case that the pH value is in the specified range of the present invention.

(8) In the case that the temperature of electrolyte is lower than the specified range of the present invention, (Comparative Example 10), burn of coating occurs, and the adhesiveness of the Fe—Ni—Zn film degrades, thus the press-formability, the spot-weldability, and the adhesiveness are inferior to those in the case that the temperature described above is in the specified range of the present invention.

(9) In the case that the temperature of washing water in succeeding step to the electrolysis treatment is lower than the specified range of the present invention, (Comparative Examples 11 through 13, 15, and 17), the thickness of oxide layer in the surface layer part of Fe—Ni—Zn film becomes thin, and the press-formability is somewhat inferior to that in the case that the temperature of washing water is in the specified range of the present invention.

(10) All the Examples 1 through 18 which were processed under a condition within the specified range of the present invention show excellent press-formability, spot-weldability, and adhesiveness.

Example 2

Three kinds of zinciferous coated steel sheets similar to those used in Embodiment 1 were subjected to cathodic electrolysis treatment under similar conditions in an electrolyte consisting of an acidic sulfate aqueous solution containing $Fe^{2+}$ ion, $Ni^{2+}$ ion, and $Zn^{2+}$ ion, as in Embodiment 1. Thus processed zinciferous coated steel sheets underwent steam blowing and/or water washing, then dried. During the steam blowing treatment, the steam flow rate was kept constant at 40 g/m$^2$ while the temperature thereof was changed. The water washing treatment was carried out under a constant water condition of 25° C.C and 1 l/min. Through the processing, an Fe—Ni—Zn film was formed on each of the zinciferous coated steel sheets.

Tables 14 and 15 show the detailed condition to form Fe—Ni—Zn film for Examples 1 through 13 which correspond to the methods within the range of the present invention, and for Comparative Examples 1 through 16 which correspond to the methods outside of the range of the present invention at least one requirement thereof.

TABLE 14

| | Conditions of electrolysis | | | | | | | | |
|---|---|---|---|---|---|---|---|---|---|
| | Electrolyte | | | | Liquid | | Coat- | Post-electrolysis treatment | |
| Coat-ing Type | Composition | Concent-ratio of sum of $Fe^{2+}$ and $Ni^{2+}$(mol/l) | pH | Tempe-rature (° C.) | flow speed (m/s) | Current density (A/dm$^2$) | ing time (sec) | Steam flow rate: 40 g/m$^2$ Temperature of washing water: 25° C. Flow rate of washing water: 11/m$^2$ | Test No. |
| GA | — | — | — | — | — | — | — | — | Comparative 1 |
| | Nickel sulfate 1.8 mol/l<br>Ferrous sulfate 0.0 mol/l<br>Zinc sulfate 0.05 mol/l<br>Boric acid 30 g/l | 1.8 | 2.0 | 50 | 2.0 | 10 | 2 | Steam blow (140° C.)→Water washing→ Drying | Comparative 2 |
| | Nickel sulfate 1.8 mol/l<br>Ferrous sulfate 0.01 mol/l<br>Zinc sulfate 0.05 mol/l<br>Boric acid 30 g/l | 1.81 | 2.0 | 50 | 2.0 | 10 | 2 | Steam blow (140° C.)→Water washing→ Drying | Comparative 3 |
| | Nickel sulfate 1.8 mol/l<br>Ferrous sulfate 0.02 mol/l<br>Zinc sulfate 0.05 mol/l<br>Boric acid 30 g/l | 1.82 | 2.0 | 50 | 2.0 | 10 | 2 | Steam blow (140° C.)→Water washing→ Drying | Invention 1 |
| | Nickel sulfate 1.8 mol/l<br>Ferrous sulfate 0.2 mol/l<br>Zinc sulfate 0.05 mol/l<br>Boric acid 30 g/l | 2.0 | 2.0 | 50 | 2.0 | 7 | 7 | Steam blow (120° C.)→Water washing→ Drying | Comparative 4 |
| | | | | | | 10 | 2 | | Invention 2 |
| | | | | | | 50 | 0.5 | | Invention 3 |
| | | | | | | 100 | 0.2 | | Invention 4 |
| | | | | | | 140 | 0.2 | | Invention 5 |
| | | | | | | 170 | 0.2 | | Comparative 5 |
| | Nickel sulfate 0.15 mol/l<br>Ferrous sulfate 0.03 mol/l<br>Zinc sulfate 0.02 mol/l<br>Boric acid 30 g/l | 0.18 | 2.8 | 60 | 2.0 | 50 | 0.5 | Steam blow (140° C.)→Water washing→ Drying | Comparative 6 |
| | Nickel sulfate 0.3 mol/l<br>Ferrous sulfate 0.06 mol/l<br>Zinc sulfate 0.04 mol/l<br>Boric acid 30 g/l | 0.36 | 2.8 | 60 | 2.0 | 50 | 0.5 | Steam blow (140° C.)→Water washing→ Drying | Invention 6 |
| | Nickel sulfate 1.0 mol/l<br>Ferrous sulfate 1.0 mol/l<br>Zinc sulfate 0.2 mol/l<br>Boric acid 30 g/l | 2.0 | 1.8 | 50 | 1.0 | 70 | 0.2 | Steam blow (140° C.)→Water washing→ Drying | Invention 7 |
| | Nickel sulfate 0.5 mol/l<br>Ferrous sulfate 1.5 mol/l<br>Zinc sulfate 0.2 mol/l<br>Boric acid 30 g/l | 2.0 | 1.8 | 50 | 1.0 | 70 | 0.2 | Steam blow (140° C.)→Water washing→ Drying | Comparative 7 |

TABLE 15

| Coating Type | Conditions of electrolysis: Electrolyte: Composition | Concent-ratio of sum of $Fe^{2+}$ and $Ni^{2+}$(mol/l) | pH | Temperature (° C.) | Liquid flow speed (m/s) | Current density ($A/dm^2$) | Coating time (sec) | Post-electrolysis treatment (Steam flow rate: 40 $g/m^2$; Temperature of washing water: 25° C.; Flow rate of washing water: 11/$m^2$) | Test No. |
|---|---|---|---|---|---|---|---|---|---|
| GA | Nickel sulfate 1.8 mol/l<br>Ferrous sulfate 0.2 mol/l<br>Zinc sulfate 0.5 mol/l<br>Boric acid 30 g/l | 1.5 | 2.0 | 60 | 2.0 | −90 | 0.2 | Steam blow (140° C.)→Water washing→Drying | Invention 8 |
| | Nickel sulfate 1.3 mol/l<br>Ferrous sulfate 0.2 mol/l<br>Zinc sulfate 1.0 mol/l<br>Boric acid 30 g/l | 1.5 | 2.0 | 60 | 2.0 | 90 | 0.2 | Steam blow (140° C.)→Water washing→Drying | Comparative 8 |
| | Nickel sulfate 1.3 mol/l<br>Ferrous sulfate 0.2 mol/l | 1.5 | 0.8 | 45 | 1.5 | 50 | 2 | Steam blow (120° C.)→Water washing→Drying Drying | Comparative 9 |
| | Zinc sulfate 0.3 mol/l<br>Boric acid 30 g/l | | 1.2 | 45 | 1.5 | 50 | 2 | Steam blow (120° C.)→Water washing→Drying | Invention 9 |
| | Nickel sulfate 0.6 mol/l<br>Ferrous sulfate 0.1 mol/l | 0.7 | 2.2 | 25 | 2.5 | 50 | 0.5 | Steam blow (140° C.)→Water washing→Drying | Comparative 10 |
| | Zinc sulfate 0.1 mol/l<br>Boric acid 30 g/l | | | 35 | 2.5 | 50 | 0.5 | Steam blow (140° C.)→Water washing→Drying | Invention 10 |
| | Nickel sulfate 1.1 mol/l<br>Ferrous sulfate 0.1 mol/l | 1.2 | 2.0 | 50 | 2.0 | 50 | 0.5 | Water washing→Drying | Comparative 11 |
| | Zinc sulfate 0.3 mol/l<br>Boric acid 30 g/l | | | | | | | Water washing→Steam blow(160° C.)→Drying | Comparative 12 |
| | | | | | | | | Steam blow(160° C.)→Water washing→Drying | Invention 11 |
| GI | — | — | — | — | — | — | — | — | Comparative 13 |
| | Nickel sulfate 1.0 mol/l | 1.1 | 2.0 | 50 | 2.0 | 50 | 0.5 | Water washing→Drying | Comparative 14 |
| | Ferrous sulfate 0.1 mol/l<br>Zinc sulfate 0.1 mol/l<br>Boric acid 30 g/l | | | | | | | Steam blow(140° C.)→Water washing→Drying | Invention 12 |
| EG | — | — | — | — | — | — | — | — | Comparative 15 |
| | Nickel sulfate 1.0 mol/l | 1.1 | 2.0 | 50 | 2.0 | 50 | 0.5 | Water washing→ | Comparative 16 |
| | Ferrous sulfate 0.1 mol/l<br>Zinc sulfate 0.1 mol/l<br>Boric acid 30 g/l | | | | | | | Steam blow(140 ° C.)→Water washing→Drying | Invention 13 |

Under the conditions given above, specimens were prepared from individual zinciferous coated steel sheets with Fe—Ni—Zn film formed thereon. Specimens were also prepared from the steel sheet which was not subjected to forming the Fe—Ni—Zn film on the surface thereof. Similar to Embodiment 1, thus prepared specimens underwent the analysis of Fe—Ni—Zn film and the characteristics evaluation tests in terms of press-formability, spot-weldability, and adhesiveness for the zinciferous coated steel sheets, similar with those applied in Embodiment 1. The results are shown in Table 16.

TABLE 16

| Coating Type | Test No. | Fe—Ni—Zn film: Fe + Ni ($mg/m^2$) | Fe/(Fe + Ni) | Zn/(Fe + Ni) | Thickness of oxide layer (nm) | Press-formability Friction factor | Spot-weldability Number of continuous welding spots | Adhesion performance Peel strength (kgf/25 mm) |
|---|---|---|---|---|---|---|---|---|
| GA | Comparative 1 | 0 | — | — | — | 0.172 | 2800 | 6.1 |
| | Comparative 2 | 160 | 0 | 0.91 | 19 | 0.110 | 6000 | 3.9 |
| | Comparative 3 | 140 | 0.07 | 0.81 | 18 | 0.111 | 5800 | 8.1 |
| | Invention 1 | 150 | 0.14 | 0.86 | 20 | 0.109 | 5900 | 11.8 |
| | Comparative 4 | 7 | 0.50 | 13 | 12 | 0.166 | 3200 | 8.2 |
| | Invention 2 | 150 | 0.42 | 0.72 | 15 | 0.110 | 5800 | 12.0 |
| | Invention 3 | 220 | 0.32 | 0.35 | 16 | 0.110 | 6200 | 11.9 |
| | Invention 4 | 350 | 0.20 | 0.20 | 15 | 0.111 | 5900 | 12.1 |
| | Invention 5 | 620 | 0.18 | 0.16 | 16 | 0.109 | 6400 | 12.0 |
| | Comparative 5 | 480 | 0.15 | 0.11 | 15 | 0.165 | 3000 | 6.1 |
| | Comparative 6 | 100 | 0.21 | 0.61 | 20 | 0.164 | 2900 | 6.6 |
| | Invention 6 | 160 | 0.24 | 0.52 | 22 | 0.112 | 6000 | 12.1 |
| | Invention 7 | 200 | 0.72 | 0.40 | 19 | 0.111 | 5900 | 11.9 |

TABLE 16-continued

| Coating Type | Test No. | Fe—Ni—Zn film: Fe + Ni ($mg/m^2$) | Fe/(Fe + Ni) | Zn/(Fe + Ni) | Thickness of oxide layer (nm) | Press-formability Friction factor | Spot-weldability Number of continuous welding spots | Adhesion performance Peel strength (kgf/25 mm) |
|---|---|---|---|---|---|---|---|---|
| | Comparative 7 | 190 | 0.90 | 0.40 | 21 | 0.110 | 3200 | 12.1 |
| | Invention 8 | 200 | 0.22 | 1.30 | 20 | 0.112 | 6000 | 12.0 |
| | Comparative 8 | 130 | 0.24 | 2.00 | 20 | 0.130 | 4300 | 11.9 |
| | Comparative 9 | 7 | 0.21 | 13 | 13 | 0.165 | 3200 | 8.2 |
| | Invention 9 | 50 | 0.31 | 1.5 | 13 | 0.115 | 6100 | 12.2 |
| | Comparative 10 | 60 | 0.2 | 2.0 | 20 | 0.162 | 3100 | 6.2 |
| | Invention 10 | 90 | 0.42 | 0.42 | 19 | 0.111 | 6200 | 12.1 |
| | Comparative 11 | 190 | 0.15 | 0.22 | 1.2 | 0.125 | 5800 | 12.0 |
| | Comparative 12 | 180 | 0.14 | 0.26 | 1.9 | 0.124 | 6000 | 11.8 |
| | Invention 11 | 190 | 0.15 | 0.42 | 25 | 0.110 | 6000 | 11.8 |
| GI | Comparative 13 | — | — | — | — | 0.210 | 900 | 4.0 |
| | Comparative 14 | 230 | 0.16 | 0.14 | 1.5 | 0.132 | 4200 | 12.0 |
| | Invention 12 | 220 | 0.14 | 0.31 | 20 | 0.112 | 4300 | 12.2 |
| EG | Comparative 15 | — | — | — | — | 0.152 | 1900 | 5.8 |
| | Comparative 16 | 210 | 0.17 | 0.15 | 1.5 | 0.127 | 4100 | 12.1 |
| | Invention 13 | 230 | 0.16 | 0.34 | 20 | 0.110 | 4300 | 12.0 |

The following was revealed from the forming conditions of Fe—Ni—Zn film, which are shown in Tables 14 and 15, and from the test results shown in Table 16.

(1) In the case that no Fe—Ni—Zn film is formed, (Comparative Examples 1, 13, and 15), all the coatings of GA, GI, and EG, on the zinciferous coated steel sheet are inferior in press-formability, spot-weldability, and adhesiveness to those in the case that an Fe—Ni—Zn film within the specified range of the present invention is formed.

(2) In the case that the concentration of $Fe^{2+}$ ion in electrolyte is lower than the specified range of the present invention, (Comparative Examples 2 and 3), the content of Fe/(Fe+Ni) in Fe—Ni—Zn film is small and the adhesiveness is inferior to that in the case that the above-described ion concentration is within the range of the present invention.

(3) In the case that the current density of electrolysis is less than the specified range of the present invention, (Comparative Example 4), the content of (Fe+Ni) in Fe—Ni—Zn film is small because of poor current efficiency, and the press-formability, the spot-weldability, and the adhesiveness are inferior to those in the case that the current density is within the specified range of the present invention. On the other hand, if the current density of electrolysis is larger than the specified range of the present invention, (Comparative Example 5), burn of coating occurs, and the adhesiveness of the Fe—Ni—Zn film degrades, thus the press-formability, the spot-weldability, and the adhesiveness are inferior to those in the case that the current density is in the specified range of the present invention.

(4) In the case that the concentration of ($Fe^{2+}$+$Ni^{2+}$ ions) in electrolyte is less than the specified range of the present invention, (Comparative Example 6), burn of coating occurs, and the adhesiveness of the Fe—Ni—Zn film degrades, thus the press-formability, the spot-weldability, and the adhesiveness are inferior to those in the case that the ion concentration described above is in the specified range of the present invention.

(5) In the case that the concentration of $Fe^{2+}$ ion in electrolyte is higher than the specified range of the present invention, (Comparative Example 7), the content of Fe/(Fe+Ni) in Fe—Ni—Zn film is large and the spot-weldability is inferior to that in the case that $Fe^{2+}$ ion concentration is within the range of the present invention.

(6) In the case that the concentration of $Zn^{2+}$ ion in electrolyte is higher than the specified range of the present invention, (Comparative Example 8), the content of Zn/(Fe+Zn) in Fe—Ni—Zn film is large and the spot-weldability is inferior to that in the case that $Zn^{2+}$ ion concentration is within the range of the present invention.

(7) In the case that the pH value in electrolyte is less than the specified range of the present invention, (Comparative Example 9), the content of (Fe+Ni) in Fe—Ni—Zn film is small because of poor current efficiency, thus the press-formability, the spot-weldability, and the adhesiveness are inferior to those in the case that the pH value is in the specified range of the present invention.

(8) In the case that the temperature of electrolyte is lower than the specified range of the present invention, (Comparative Example 10), burn of coating occurs, and the adhesiveness of the Fe—Ni—Zn film degrades, thus the press-formability, the spot-weldability, and the adhesiveness are inferior to those in the case that the temperature described above is in the specified range of the present invention.

(9) In the case that no steam blowing is applied in succeeding step to the electrolysis treatment, (Comparative Examples 11 12, 14, and 16), the thickness of oxide layer in the surface layer part of Fe—Ni—Zn film becomes thin, and the press-formability is somewhat inferior to that in the case that above-described temperature is in the specified range of the present invention.

(10) All the Examples 1 through 13 which were processed under a condition within the specified range of the present invention show excellent press-formability, spot-weldability, and adhesiveness.

What is claimed is:

1. A zinciferous coated steel sheet comprising:

a steel sheet;

a zinciferous coating layer which is formed on the steel sheet;

a Fe—Ni—Zn—O film which is formed on the zinciferous coating layer;

an oxide layer which is formed on a surface portion of the Fe—Ni—Zn—O film;

the Fe—Ni—Zn—O film comprising metallic Ni and an oxide of Fe, Ni and Zn;

the Fe—Ni—Zn—O film having a Fe ratio of 0.004 to 0.9 and a Zn ratio of 0.08 to 0.6, said Fe ratio being a ratio of Fe content (wt. %) to the sum of Fe content (wt. %), Ni content (wt. %), and Zn content (wt. %) in the Fe—Ni—Zn—O film, said Zn ratio being a ratio of Zn content (wt. %) to the sum of Fe content (wt. %), Ni content (wt. %), and Zn content (wt. %) in the Fe—Ni—Zn—O film;

the oxide layer comprising an oxide of Fe, Ni and Zn; and the oxide layer having a thickness of 0.5 to 50 nanometer.

2. The zincierous coated steel sheet of claim 1, wherein the Fe—Ni—Zn—O film comprises metallic Ni, an oxide of Fe, Ni and Zn, and a hydroxide of Fe, Ni and Zn.

3. The zinciferous coated steel sheet of claim 1, wherein the oxide layer comprises an oxide of Fe, Ni and Zn, and a hydroxide of Fe, Ni and Zn.

4. The zinciferous coated steel sheet of claim 1, wherein the Fe—Ni—Zn—O film has a coating weight of 10 to 2500 $mg/m^2$.

5. The zinciferous coated steel sheet of claim 1, wherein the Zn ratio of the Fe—Ni—Zn—O film is 0.11 to 0.6.

6. The zinciferous coated steel sheet of claim 5, wherein the Zn ratio of the Fe—Ni—Zn—O film is 0.16 to 0.6.

7. The zinciferous coated steel sheet of claim 6, wherein the Zn ratio of the Fe—Ni—Zn—O film is 0.20 to 0.6.

8. The zinciferous coated steel sheet of claim 6, wherein the Zn ratio of the Fe—Ni—Zn—O film is 0.26 to 0.6.

* * * * *